US010597935B2

(12) United States Patent
Rupel et al.

(10) Patent No.: US 10,597,935 B2
(45) Date of Patent: Mar. 24, 2020

(54) VERTICAL CELLULAR DRAPE FOR AN ARCHITECTURAL STRUCTURE

(71) Applicant: Hunter Douglas, Inc., Pearl River, NY (US)

(72) Inventors: John D. Rupel, Pine River, WI (US); Ren Judkins, Pittsburgh, PA (US); Scott R. Cheslock, Bonduel, WI (US); Toralf H. Strand, Kittery, ME (US)

(73) Assignee: Hunter Douglas Inc., Pearl River, NY (US)

( * ) Notice: Subject to any disclaimer, the term of this patent is extended or adjusted under 35 U.S.C. 154(b) by 379 days.

(21) Appl. No.: 15/414,718

(22) Filed: Jan. 25, 2017

(65) Prior Publication Data

US 2018/0209211 A1 Jul. 26, 2018

(51) Int. Cl.

| | |
|---|---|
| ***E06B 9/262*** | (2006.01) |
| ***E06B 9/36*** | (2006.01) |
| *E06B 9/24* | (2006.01) |

(52) U.S. Cl.

CPC ..... *E06B 9/262* (2013.01); *E06B 9/36* (2013.01); *E06B 2009/2458* (2013.01); *E06B 2009/2627* (2013.01)

(58) Field of Classification Search

CPC ..... E06B 9/262; E06B 2009/2625; E06B 2009/2627; E06B 9/36

See application file for complete search history.

(56) References Cited

U.S. PATENT DOCUMENTS

| | | | | |
|---|---|---|---|---|
| 2,717,033 A * | 9/1955 | Breslow | A47H 5/032 160/199 |
| 2,754,901 A | 7/1956 | Madsen | |
| 2,803,578 A * | 8/1957 | Holland | B31D 5/00 156/197 |
| 3,039,574 A | 6/1962 | Miller | |
| 3,148,726 A | 9/1964 | Herbert | |
| 3,242,972 A | 3/1966 | Trusdale | |
| 3,254,464 A | 6/1966 | Hoyt | |

(Continued)

FOREIGN PATENT DOCUMENTS

| | | |
|---|---|---|
| WO | WO 94/25719 | 11/1994 |
| WO | WO 96/25077 | 8/1996 |

(Continued)

OTHER PUBLICATIONS

United Kingdom Search and Examination Report Issued in Corresponding Application No. GB1701249.3 dated Apr. 18, 2019 (6 Pages).

*Primary Examiner* — Katherine W Mitchell
*Assistant Examiner* — Abe Massad
(74) *Attorney, Agent, or Firm* — Dority & Manning, P.A.

(57) ABSTRACT

A vertical cellular drape configured for use as a covering for an architectural structure may include a front drape panel and a rear drape panel. The front and rear drape panels may be coupled to each other so that the drape panels are configured to be moved laterally between an extended position and a retracted position to cover or expose an adjacent architectural structure, as desired. In addition, the drape panels may be configured to be positioned relative to each other such that a plurality of vertically oriented, internal cells are defined between the drape panels.

26 Claims, 16 Drawing Sheets

(56) References Cited

U.S. PATENT DOCUMENTS 3,399,713 A * 9/1968 Wilson ..... A47H 13/14 160/348
3,460,603 A * 8/1969 Toder ..... E06B 9/36 160/345
3,599,702 A * 8/1971 Bedard ..... E01D 15/122 160/44
3,844,330 A 10/1974 Hyman
3,910,338 A * 10/1975 Pontoppidan ..... E06B 3/481 160/199
4,095,639 A * 6/1978 Ryan ..... A01G 9/225 160/84.02
4,307,768 A 12/1981 Anderson
4,390,055 A 6/1983 Fenley
4,450,027 A 5/1984 Colson
4,915,153 A * 4/1990 Toti ..... A47H 1/04 160/330
RE33,623 E 6/1991 Anderson
5,109,912 A 5/1992 Gary
5,135,461 A 8/1992 Corey
5,193,601 A 3/1993 Corey
5,297,607 A * 3/1994 Beauchamp ..... E06B 9/367 160/84.04
D347,348 S 5/1994 Chen
5,339,883 A * 8/1994 Colson ..... E06B 9/262 160/176.1 V
5,351,737 A * 10/1994 Hoshiyama ..... E06B 9/262 160/84.03
D352,856 S 11/1994 Ford
5,454,414 A 10/1995 Colson et al.
5,490,553 A 2/1996 Colson
5,547,006 A 8/1996 Auger
5,558,925 A 9/1996 Fritzman
5,692,550 A 12/1997 Ford
5,701,940 A 12/1997 Ford
5,746,266 A 5/1998 Colson et al.
5,749,404 A 5/1998 Colson
5,765,260 A 6/1998 Judkins
5,797,442 A 8/1998 Colson
5,834,090 A 11/1998 Huang
5,837,084 A 11/1998 Barss
5,857,511 A * 1/1999 Judkins ..... A47H 13/14 160/348
5,876,545 A 3/1999 Swiszcz et al.
6,024,819 A 2/2000 Corey
6,103,336 A 8/2000 Swiszcz
6,152,205 A 11/2000 Toti
6,170,548 B1 1/2001 Swiszcz et al.
6,171,424 B1 1/2001 Barss
6,186,213 B1 2/2001 Senesac
6,302,982 B1 10/2001 Corey
6,478,905 B2 11/2002 Swiszcz et al.
6,510,885 B1 1/2003 Shih
6,533,017 B1 3/2003 Toti
6,598,650 B1 * 7/2003 Palmer ..... B29C 53/52 160/236
6,640,867 B1 11/2003 Pallotta
D493,057 S 7/2004 Newlon
6,938,664 B2 * 9/2005 Hsu ..... E06B 9/266 156/292
6,989,066 B2 1/2006 Yu
7,074,475 B2 7/2006 Yu
7,404,428 B2 7/2008 Sun et al.
7,541,082 B2 6/2009 Yu
7,811,651 B2 10/2010 Yu
D643,238 S 8/2011 Buccola, Jr.
8,261,807 B2 9/2012 Dann et al.
8,353,326 B2 1/2013 Chang
8,568,859 B2 10/2013 Yu et al.
8,763,673 B2 7/2014 Jelic et al.
8,794,295 B2 8/2014 Rupel et al.
8,839,590 B1 9/2014 Kortman
8,915,288 B2 12/2014 MacAllen
D724,348 S 3/2015 Cheng
8,967,224 B2 3/2015 Foley et al.
D728,267 S 5/2015 Cha
D734,060 S 7/2015 Colson
9,157,272 B2 10/2015 Rupel
9,249,618 B2 2/2016 Sevcik et al.
9,322,210 B2 4/2016 Lukosiunas et al.
2004/0065416 A1 4/2004 Auger
2004/0231802 A1 11/2004 Hsu
2006/0196612 A1 9/2006 Strand
2006/0196615 A1 9/2006 Yu
2008/0115894 A1 * 5/2008 Cech ..... E06B 9/36 160/168.1 V
2008/0169068 A1 7/2008 Liang
2008/0251216 A1 10/2008 Hsu
2010/0126675 A1 5/2010 Jelic et al.
2010/0276089 A1 11/2010 Jelic et al.
2011/0114269 A1 5/2011 Cheng
2011/0274887 A1 11/2011 Fu-Lai et al.
2013/0180670 A1 7/2013 Judkins
2013/0228290 A1 9/2013 Rupel
2014/0053989 A1 2/2014 Colson et al.
2014/0224432 A1 8/2014 Josephson et al.
2015/0047792 A1 2/2015 Lukosiunas
2015/0167380 A1 6/2015 Farley
2015/0184450 A1 7/2015 Rupel
2015/0345214 A1 12/2015 Rupel
2016/0053531 A1 2/2016 Hsieh
2016/0069129 A1 3/2016 Lin
2018/0119487 A1 5/2018 Colson
2018/0209211 A1 7/2018 Rupel

FOREIGN PATENT DOCUMENTS

WO WO 96/35854 11/1996
WO WO 99/19592 4/1999
WO WO 00/43626 7/2000
WO WO 01/04450 1/2001
WO WO 2005/062875 7/2005
WO WO 2014/104081 7/2014
WO WO 2015/026728 2/2015
WO WO 2015/147642 A1 10/2015

* cited by examiner

VERTICAL CELLULAR DRAPE FOR AN ARCHITECTURAL STRUCTURE

FIELD OF THE INVENTION

The present subject matter relates generally to coverings for architectural structures and, more particularly, to a vertical cellular drape for an architectural structure, such as a window or a sliding glass door.

BACKGROUND OF THE INVENTION

Draperies are a popular type of covering used in residential and commercial applications to cover a window, door, and/or other architectural structure. Drapes are typically made from a single panel of fabric which is hung or suspended vertically from a rod or other carrier. The suspended drape may then be moved laterally or horizontally to cover or expose the adjacent architectural structure, as desired. Conventionally, drapes have been manufactured using a panel of fabric having a wavy profile formed from alternating, "soft" rounded bends. As a result, a typical drape will tend to splay outwardly in all directions as it descends from its constrained top. In addition, such a drape configuration typically creates a very large collection or gathering of material when the drape is moved to its retracted position along the side of the architectural structure, which can be aesthetically undesirable and also occupies a large amount of floor/window space. Moreover, conventional drapes are often difficult to package and can be quite labor-intensive for the drapery installer.

The design emphasis in home and building structures has maintained pressure on the industry to continue to create new and improved draperies for architectural structures that provide a unique, aesthetically attractive appearance for the room in which a drape(s) is installed while also exhibiting the desired light transmission/blocking properties and/or the desired insulation properties for the covering. Although some improvements have been made to drapes over the years, there still remains a need to create vertical drapes having both a unique appearance and desired functional properties for providing further options to consumers.

Accordingly, an improved, vertical cellular drape for use as a covering for an architectural structure would be welcomed in the technology.

BRIEF DESCRIPTION OF THE INVENTION

Aspects and advantages of the present subject matter will be set forth in part in the following description, or may be obvious from the description, or may be learned through practice of the present subject matter.

In various aspects, the present subject matter is directed to a vertical cellular drape configured for use as a covering for an architectural structure, such as a window or door. In one embodiment, the cellular drape includes a front drape panel and a rear drape panel. The front and rear drape panels may be coupled to each other so that the drape panels are both configured to be moved laterally between an extended position and a retracted position to at least partially cover or expose an adjacent architectural structure, as desired. In addition, the drape panels may be configured to be positioned relative to each other such that a plurality of vertically oriented, internal cells are defined between the drape panels.

These and other features, aspects and advantages of the present subject matter will become better understood with reference to the following Detailed Description and appended claims. The accompanying drawings, which are incorporated in and constitute a part of this specification, illustrate embodiments of the present subject matter and, together with the description, serve to explain the principles of the present subject matter.

This Brief Description is provided to introduce a selection of concepts in a simplified form that are further described below in the Detailed Description. This Brief Description is not intended to identify key features or essential features of the claimed subject matter, nor is it intended as an aid in determining the scope of the claimed subject matter.

BRIEF DESCRIPTION OF THE DRAWINGS

A full and enabling disclosure of the present subject matter, including the best mode thereof, directed to one of ordinary skill in the art, is set forth in the specification, which makes reference to the appended figures, in which.

DETAILED DESCRIPTION OF THE INVENTION

Figure 1:
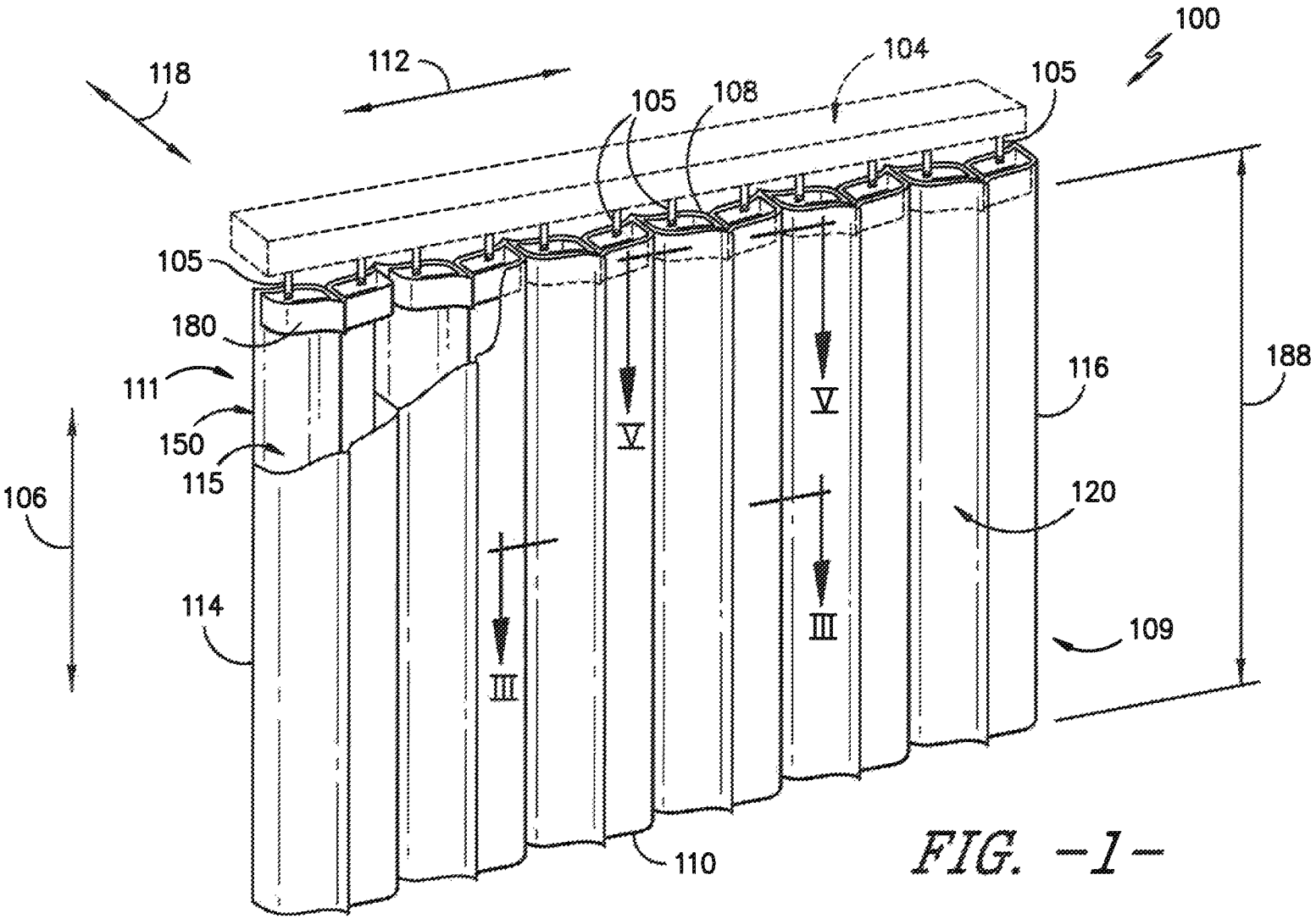
FIG. 1 illustrates a perspective view of one embodiment of a vertical cellular drape in accordance with aspects of the present subject matter, particularly illustrating the cellular drape in an extended position relative to an adjacent architectural structure (not shown) and also illustrating an upper corner of a front drape panel of the cellular drape cut-away to show a portion of a rear drape panel of the cellular drape extending behind the front drape panel.

In general, the present subject matter is directed to a vertical cellular drape that can be installed relative to an architectural feature or structure (referred to herein simply as an architectural "structure" for the sake of convenience without intent to limit), such as a window or door, for various purposes, including without limitation, blocking light, providing privacy, increasing the aesthetic appeal of a room and/or allowing a desired amount of light into a room. In several embodiments, the cellular drape may be configured to extend in a vertical direction between a top end and a bottom end and in a lateral direction between a first lateral end and a second lateral end. In addition, the cellular drape may be movable in the lateral direction between an extended position and a retracted position.

In one embodiment, the cellular drape includes a first or front drape panel that defines a front face of the cellular drape and a second or rear drape panel that defines a rear face of the cellular drape. Additionally, in one embodiment, the front and rear drape panels are configured to be positioned relative to each other when the cellular drape is in the extended position such that a plurality of vertically oriented internal cells are defined between the drape panels. For instance, each internal cell may extend lengthwise along the height or vertical length of the cellular drape defined between the top and bottom ends of the drape.

Additionally, in one embodiment, the cellular drape may be suspended from a suitable support structure (e.g., a headrail assembly, a blind tract assembly, and/or a carrier system) to allow the cellular drape to be moved horizontally or laterally between the extended and retracted positions. In the extended position, the cellular drape may be configured to extend in the lateral direction across all or a portion of the width of the adjacent architectural structure to cover such structure. Similarly, in the retracted position, the cellular drape may be configured to be collapsed into a folded or accordion-style configuration having a substantially flattened cellular profile. In the retracted position, the cellular drape may be positioned to one side of the adjacent architectural structure to allow the architectural structure to be exposed.

Moreover, in one embodiment, the internal cells of the cellular drape may be configured to define an angled orientation in the cross-wise direction of the drape when the drape is moved to the extended position. In such an embodiment, the specific angular orientation taken on or defined by the cells may generally vary depending on the degree to which the cellular drape has been extended from its retracted position. For instance, as the cellular drape is extended or unfolded from the retracted position, the cross-wise angular orientation of the internal cells may be decreased as the lateral spacing between opposed lateral sides or ends of each internal cell is increased.

In one embodiment, the internal cells may be configured to define alternating angled orientations in the cross-wise direction of the cellular drape. For instance, the cellular drape may include alternating first and second internal cells positioned end-to-end across the lateral width of the drape. In such an embodiment, each first internal cell may be configured to define a first angular orientation in the cross-wise direction that is directed towards the front face of the cellular drape while each second internal cell may be configured to define a second angular orientation in the cross-wise direction that is directed towards the rear face of the cellular drape. Such alternating angled orientations may, for example, create a staggered or zig-zagged profile between the opposed lateral ends of the cellular drape as each internal cell extends at a cross-wise angle that is oriented in the opposite direction as the corresponding cross-wise angles of its adjacent internal cells.

Moreover, in one embodiment, the cellular drape includes a plurality of headers coupled between the front and rear drape panels. Specifically, each header may be coupled between the front and rear drape panels at or adjacent to the top end of the cellular drape to provide structural support for the drape. In such an embodiment, the front and rear drape panels may be configured to extend vertically downwardly from the headers relative to each other when the cellular drape is in the extended position such that the internal cells defined between the drape panels extend lengthwise in the vertical direction from the headers to bottom end of the cellular drape.

In one embodiment, the headers are formed from a material that is more stiff or rigid than the material used to form the drape panels. As such, the headers may assist in forming and maintaining the shape of the internal cells defined between the drape panels when the cellular drape is moved to the extended position. For example, due to the properties of the material used to form the headers, each header may be configured to spring or expand outwardly to push or force adjacent portions of the drape panels apart from each other as the cellular drape is extended to facilitate formation of the internal cells between the drape panels.

In one embodiment, each header includes a front wall configured to be coupled to the front drape panel and a rear wall configured to be coupled to the rear drape panel. In addition, in one embodiment, the front and rear walls of each header are configured to extend between opposed fold or crease lines. The front and rear walls may be configured to collapse towards each other relative to the opposed crease lines into a substantially flat configuration when the cellular drape is moved to the retracted position. Similarly, when the cellular drape is moved to the extended position, the front and rear walls of each header may be configured to expand outwardly from each other relative to the opposed crease lines into an opened or expanded configuration to assist in the formation of the internal cells.

Moreover, in one embodiment, the headers may also be configured to serve as the primary attachment structure for coupling the drape panels to the corresponding support structure (e.g., a headrail assembly, a blind tract assembly, and/or a carrier system). In such an embodiment, the headers may allow for the front and rear drape panels to be suspended from the support structure without compromising the integrity of both panels and/or without compromising the otherwise uniform appearance of the front and/or rear face of the cellular drape. For instance, the headers may eliminate the need to have openings defined through the front drape panel to allow the drape to be suspended from the support structure.

Additionally, in one embodiment, the headers may be configured to serve as the primary attachment structure for coupling the front drape panel to the rear drape panel. For instance, in one embodiment, the front and rear drape panels may only be configured to be coupled to each other at the top end of the cellular drape via the headers. In such an embodiment, each drape panel may be suspended from the headers without being coupled to the other drape panel along the remainder of its vertical height. For instance, the front and rear drape panels may be configured to simply hang from the headers adjacent to each other without having any other connection between the drape panels vertically below the headers.

Further, in one embodiment, each drape panel has a pleated configuration. For instance, the front drape panel may define a plurality of front pleats across the front face of the cellular drape while the rear drape panel may define a plurality of rear pleats across the rear face of the cellular drape. In one embodiment, when the cellular drape is moved between the retracted and extended positions, each of the rear pleats may be disposed proximal to a corresponding front pleat of the front drape panel to form a plurality of corresponding pairs of front and rear pleats. Additionally, since the front and rear pleats may, for example, correspond to permanently set, sharp creases or folds in the drape panels, the pleats may provide the cellular drape with a very uniform appearance and may also facilitate collapsing the drape into its folded or accordion-style configuration in the retracted position.

In one embodiment, the front pleats defined by the front drape panel include a plurality of alternating front pleat peaks and front pleat valleys spaced apart laterally across the front face of the cellular drape. Similarly, the rear pleats defined by the rear drape panel include a plurality of alternating rear pleat peaks and rear pleat valleys spaced apart laterally across the rear face of the cellular drape In such an embodiment, the pleat peaks and valleys of the front drape panel may be interleaved relative to the pleat peaks and valleys of the rear drape panel so that each pleat peak of the front drape panel is disposed proximal to a corresponding pleat valley of the rear drape panel and each pleat valley of the front drape panel is disposed proximal to a corresponding pleat peak of the rear drape panel. For instance, in a particular embodiment, each pleat peak of the front drape panel may be substantially aligned with a corresponding pleat valley of the rear drape panel and each pleat valley of the front drape panel may be substantially aligned with a corresponding pleat peak of the rear drape panel.

Moreover, in one embodiment, the cellular drape includes a plurality of internal ribs positioned between the front and rear drape panels and extending in the vertical direction of the cellular drape between its top and bottom ends. In one embodiment, each internal rib may be configured to extend between the front and rear drape panels at the location of a corresponding pair of front and rear pleats of the front and rear drape panels. For instance, when the front and rear pleats have an interleaved pleat configuration, each rib may be configured to extend between either a pleat peak and corresponding pleat valley of the front and rear panels, respectively, or a pleat valley and corresponding pleat peak of the front and rear panels, respectively.

In one embodiment, each internal cell may be defined between neighboring or adjacent internal ribs of the cellular drape. For instance, each internal cell may extend laterally or horizontally between a first lateral side and a second lateral side, with the first lateral side of each internal cell being defined at or adjacent to a given internal rib and the second lateral side of such internal cell being defined at or adjacent to the neighboring internal rib of the cellular drape.

Figure 2:
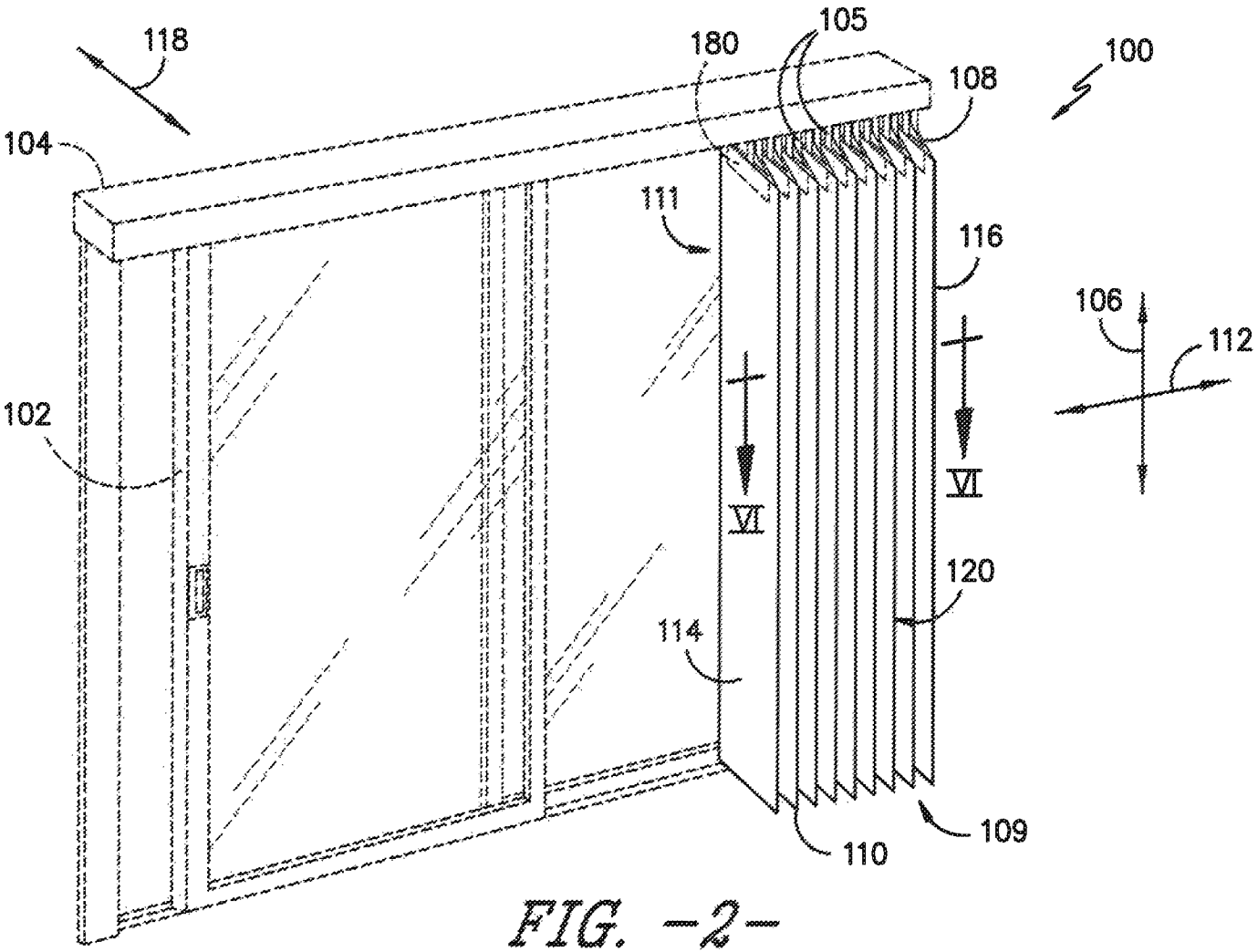
FIG. 2 illustrates another perspective view of the cellular drape shown in FIG. 1, particularly illustrating the cellular drape moved to a retracted position relative to the architectural structure.

Referring now to FIGS. 1-7, one embodiment of a vertical cellular drape 100 configured for use as a covering for an architectural structure (e.g., indicated by dashed lines 102 in FIG. 2) is illustrated in accordance with aspects of the present subject matter. In general, the cellular drape 100 may correspond to a vertical covering configured to be installed relative to a window, door, or other architectural structure as may be desired. In one embodiment, the cellular drape 100 may be placed in operative association with a head rail assembly, blind tract assembly, a carrier assembly, or any other suitable support structure (e.g., as indicated by dashed lines 104 in FIGS. 1 and 2) that is configured to vertically support the cellular drape 100 relative to an architectural structure 102. For instance, as shown in FIGS. 1 and 2, the cellular drape 100 may, for example, be suspended from the support structure 104 relative to the architectural structure 102 via a plurality of hangers 105. However, it should also be understood that the cellular drape 100 is not limited in its particular use as a covering for a window or door, and may be used in any application as a partition, shade, and/or the like, relative to and/or within any type of architectural structure.

As shown in the illustrated embodiment, when suspended by the support structure 104 relative to an architectural structure 102, the cellular drape 100 may be moveable horizontally or laterally between an extended position (FIG. 1) and a retracted position (FIG. 2). When extended, the cellular drape 100 may be configured to extend across and at least partially cover the adjacent architectural structure 102. For example, the cellular drape 100 may be configured to extend in a heightwise or vertical direction (indicated by arrow 106 shown in FIGS. 1 and 2) between a top end 108 and a bottom end 110 and in a horizontal or lateral direction (indicated by arrow 112 in FIGS. 1 and 2) between a first lateral end 114 and a second lateral end 116. Additionally, when retracted, the cellular drape 100 may generally be configured to be collapsed in the lateral direction 112 to allow the drape 100 to be positioned along one side of the adjacent architectural structure 102, thereby exposing at least a portion of the architectural structure 102. For example, as shown in the cross-sectional view of FIG. 6, when in the retracted position, the cellular drape 100 may be collapsed into a folded or accordion-style configuration having a substantially flattened cellular profile.

Figure 3:
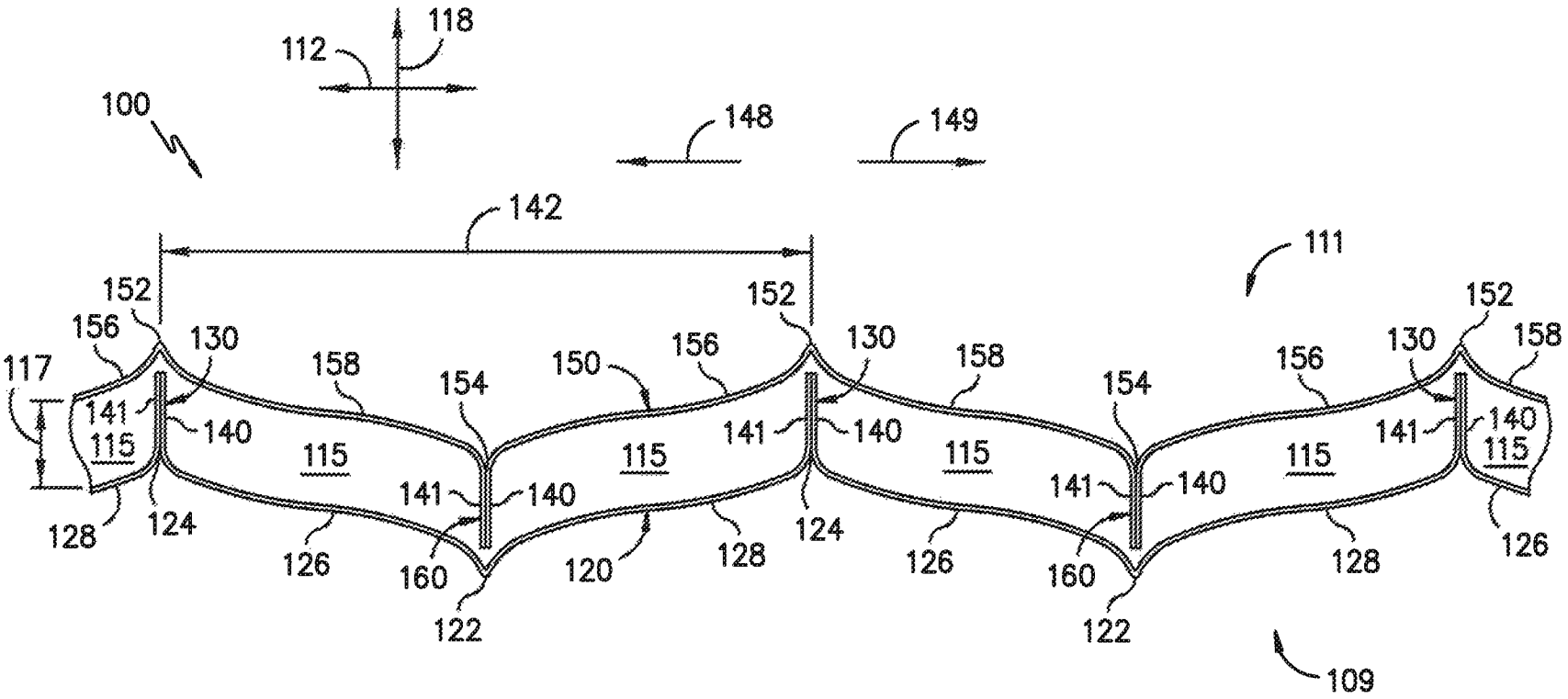
FIG. 3 illustrates a cross-sectional view of the cellular drape shown in FIG. 1 taken about line III-III.
Figure 4:
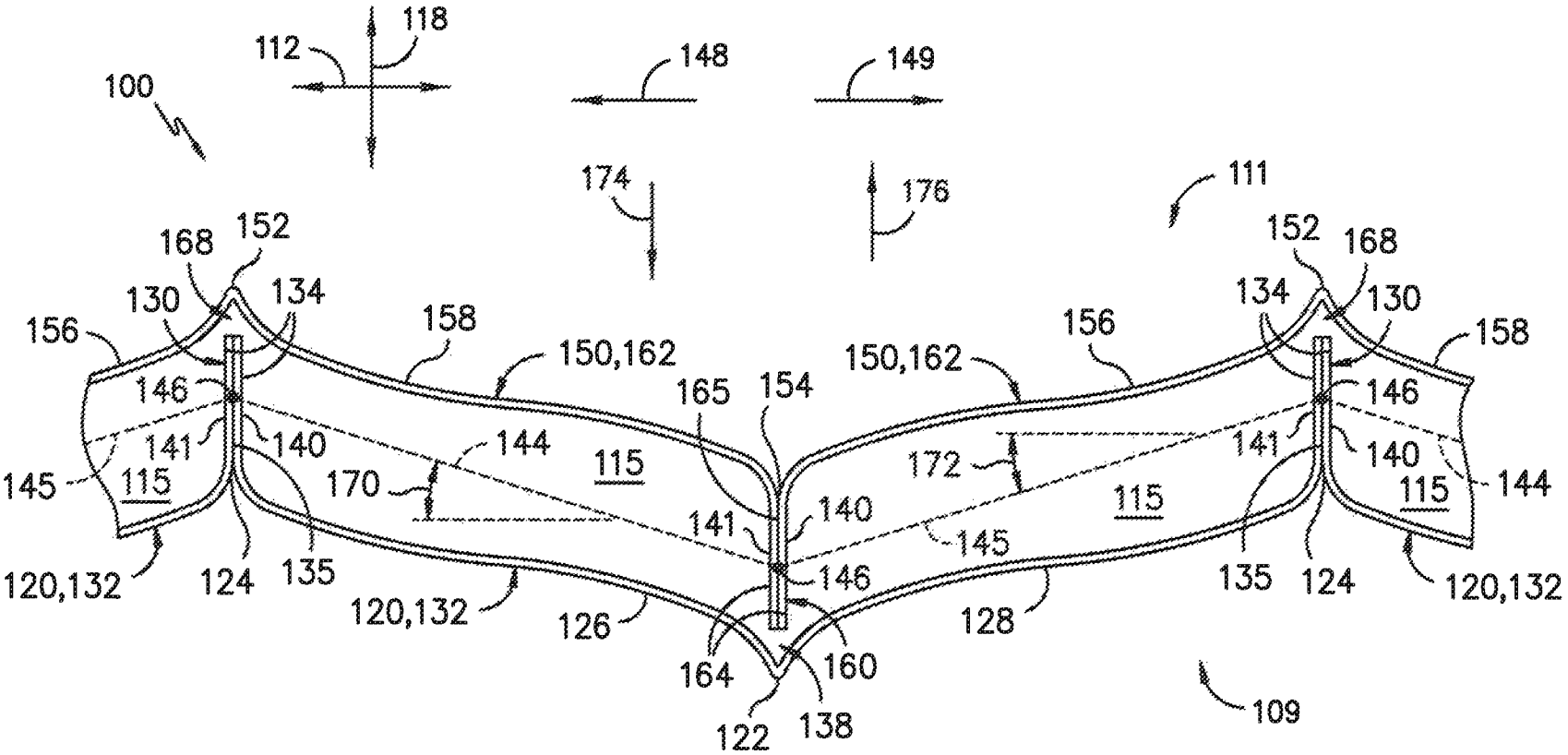
FIG. 4 illustrates an enlarged cross-sectional view of a portion of the cellular drape shown in FIG. 3.
Figure 5:
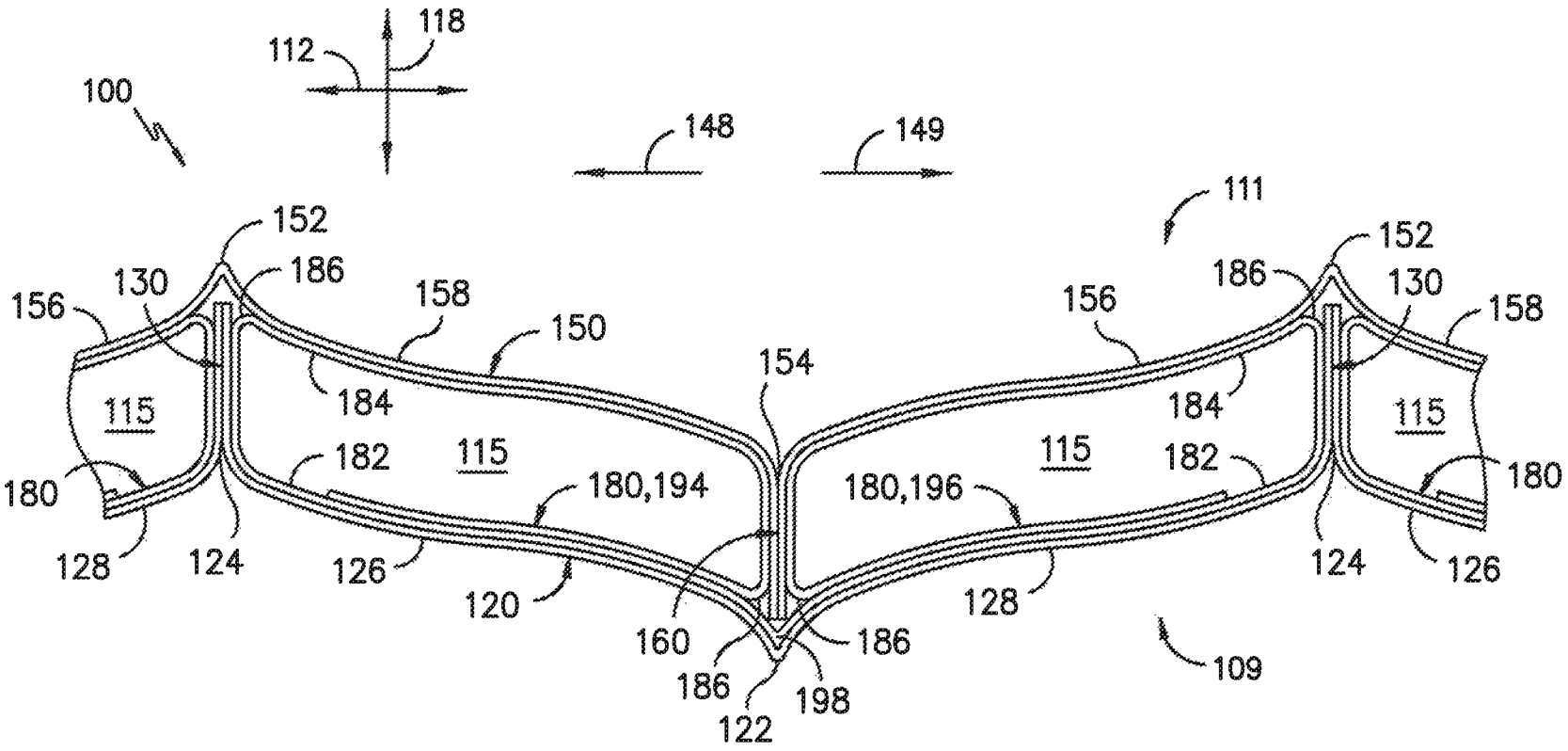
FIG. 5 illustrates another cross-sectional view of the cellular drape shown in FIG. 1 taken about line V-V.
Figure 7:
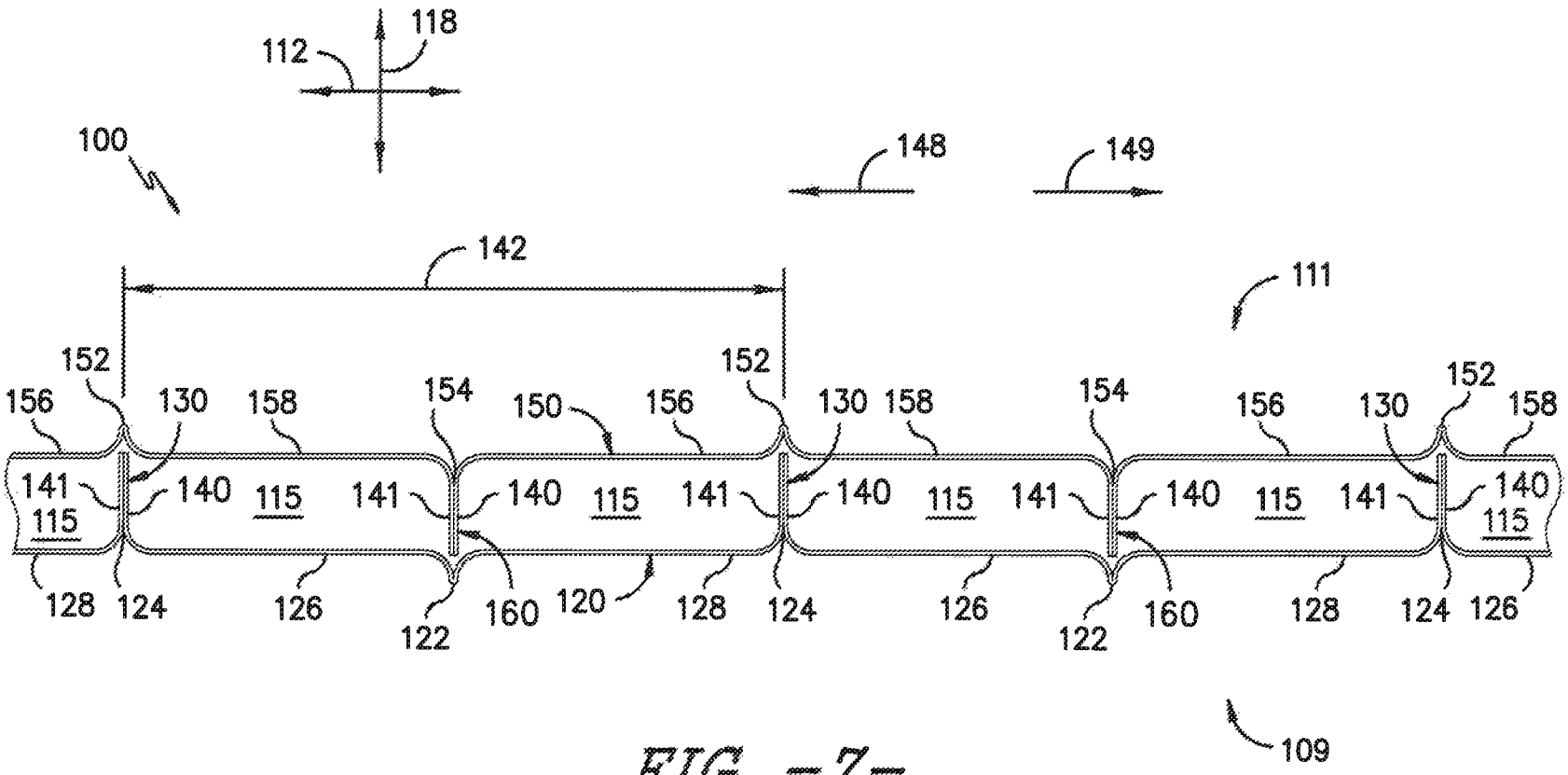
FIG. 7 illustrates a similar cross-sectional view of the cellular drape shown in FIG. 3, particularly illustrating the drape being laterally extended further than the configuration of the drape shown in FIG. 3.

It should be appreciated that, based on the specific configuration of the cellular drape 100 and the degree to which the cellular drape 100 is "extended" or "unfolded" relative to the adjacent architectural structure 102, the disclosed cellular drape 100 may be configured to take on or define various different cross-wise profiles between its opposed lateral ends 114, 116 when in the extended position. For example, FIGS. 3-5 illustrate cross-sectional views of the cellular drape 100 within which the drape 100 takes on or defines a substantially rig-zagged or staggered cross-wise profile along the lateral direction 112 when moved to the extended position. Alternatively, by increasing or decreasing the degree of extension of the cellular drape 100 relative to the configuration shown in FIGS. 3-5, the drape 100 may be configured to take on or define a different cross-wise profile. For instance, FIG. 7 illustrates the same cross-sectional view of the cellular drape 100 shown in FIG. 3 except that the drape 100 has been extended further outwardly in the lateral direction 112 away from its retracted position (e.g., by increasing the lateral tension within the cellular drape 100). As shown in FIG. 7, in such an embodiment, the cellular drape 100 takes on or defines a more planar cross-wise configuration between the opposed lateral ends 114, 116 of the drape 100.

As shown in FIGS. 1 and 3-7, in several embodiments, the cellular drape includes a pair of drape panels, such as a first or front drape panel 120 and a second or rear drape panel 150. In one embodiment, the front drape panel 120 may generally be configured to define a front side or face 109 of the cellular drape 100 (e.g., between the opposed lateral ends 114, 116 and opposed top and bottom ends 108, 110 of the drape 100 along the exposed or outer face of the front drape panel 120). Similarly, in one embodiment, the rear drape panel 150 may generally be configured to define a rear side or face 111 of the cellular drape 100 (e.g., between the opposed lateral ends 114, 116 and opposed top and bottom ends 108, 110 of the drape 100 along the exposed or outer face of the rear drape panel 150). Moreover, as will be described in greater detail below, when the cellular drape 100 is moved to the extended position, portions of the front and rear drape panels 120, 150 may be configured to be spaced apart from each other in a cross-wise direction of the cellular drape 100 (e.g., as indicated by arrow 118 in FIGS. 3-5) so that a plurality of vertically oriented internal cells 115 are defined between the drape panels 120, 150. For instance, each internal cell 115 may be configured to extend lengthwise in the vertical direction 106 between the top and bottom ends 108, 110 of the cellular drape 100 and in the cross-wise direction 118 of the drape 100 between the front and rear drape panels 120, 150.

It should be appreciated that the terms "front" and rear" are generally used herein simply to distinguish the drape panels 120, 150 from each other and/or to distinguish opposite sides or faces of the cellular drape 100, itself, and/or opposite sides or faces of other components or features of the cellular drape 100. Thus, one of ordinary skill in the art should readily appreciate that the front face 109 of the cellular drape 100 may correspond to either the side of the cellular drape 100 designed to face towards the interior of the room within which the drape 100 is installed or the side of the cellular drape 100 designed to face away from the interior of such room. However, for purposes of description, the front face 109 will be described herein as the side of the cellular drape 100 facing towards the interior of the room within which the drape 100 is installed, with the rear face 111 of the drape 100 facing towards the adjacent architectural structure 102.

It should also be appreciated that directional references are generally used herein simply for identification purposes to facilitate describing the present subject matter. However, in general, the vertical, lateral, and cross-wise directions 106, 112, 118 of the cellular drape 100 may be considered as defining a three-dimensional coordinate system. For example, the vertical direction 106 of the cellular drape 100 may be perpendicular to both the lateral and cross-wise directions 112, 118 of the drape 100. Similarly, the lateral direction 112 of the cellular drape 100 may be perpendicular to the cross-wise direction 118 of the drape 100.

In several embodiments, the drape panels 120, 150 may have a pleated configuration so that each drape panel 120, 150 includes a plurality of vertically oriented pleats (e.g., permanently set creases or folds) extending vertically between the top and bottom ends 108, 110 of the cellular drape 100. Additionally, in one embodiment, the various pleats defined by each drape panel 120, 150 may be spaced apart laterally across the width of the cellular drape 100 by wall sections of the drape panel 120, 150. For example, as particularly shown in FIGS. 3-5, the front drape panel 120 may include alternating, vertically extended front pleat peaks 122 and front pleat valleys 124 spaced apart across the front face 109 of the cellular drape 100 in the lateral direction 112. In such an embodiment, the front drape panel 120 may include first and second wall sections 126, 128 extending from each front pleat peak 122 to the adjacent peaks valleys 124 defined along either lateral side of the pleat peak 122. For instance, as shown in FIGS. 3 and 4, a first wall section 126 may extend in a first lateral direction (e.g., as indicated by arrow 148) from each front pleat peak 122 to the adjacent front pleat valley 124 in such direction. Similarly, a second wall section 128 may extend in a second lateral direction (e.g., as indicated by arrow 149 in FIGS. 3 and 4) from each front pleat peak 122 to the adjacent front pleat valley 124 in such direction.

Additionally, as particularly shown in FIGS. 3-5, the rear drape panel 150 may include alternating, vertically extended rear pleat peaks 152 and rear pleat valleys 154 spaced apart across the rear face 111 of the cellular drape 100 in the lateral direction 112. In such an embodiment, the rear drape panel 150 may similar include first and second wall sections 156, 158 extending from each rear pleat peak 152 to the adjacent rear peaks valleys 154 defined along either lateral side of the pleat peak 152. For instance, as shown in FIGS. 3 and 4, a first wall section 156 may extend in the first lateral direction (e.g., as indicated by arrow 148) from each rear pleat peak 152 to the adjacent rear pleat valley 154 in such direction. Similarly, a second wall section 158 may extend in the second lateral direction (e.g., as indicated by arrow 149 in FIGS. 3 and 4) from each rear pleat peak 152 to the adjacent rear pleat valley 154 in such direction.

It should be appreciated that, as described herein, the pleat peaks and valleys 122, 124, 152, 154 are defined relative to the outwardly-facing or exposed sides of the drape panels 120, 150. Specifically, the front pleat peaks 122 and front pleat valleys 124 are defined relative to the outwardly-facing or exposed side of the front drape panel 120 (i.e., the front face 109) such that the front pleat peaks 122 generally extend away from the rear drape panel 150 and the front pleat valleys 124 generally extend towards the rear drape panel 150 when viewing the front face 109 of the cellular drape 100. Similarly, the rear pleat peaks 152 and rear pleat valleys 154 are defined relative to the outwardly-facing or exposed side of the rear drape panel 150 (i.e., the rear face 111) such that the rear pleat peaks 152 generally extend away from the front drape panel 120 and the rear pleat valleys 154 generally extend towards the front drape panel 120 when viewing the rear face 111 of the cellular drape 100.

In several embodiments, the pleat peaks and valleys 122, 124 defined by the front drape panel 120 across the front face 109 of the cellular drape 100 may be interleaved relative to the pleat peaks and valleys 152, 154 defined by the rear drape panel 150 across the rear face 111 of the cellular drape 100. Specifically, as shown in FIGS. 3-5, the pleat peaks and valleys 122, 124, 152, 154 are provided in an alternating configuration across the front and rear faces 109, 111 of the cellular drape 100 such that each front pleat peak 122 is disposed in proximity with a corresponding rear pleat valley 154 (e.g., in the lateral and/or cross-wise directions 112, 118 of the drape 100) and each front pleat valley 124 is disposed in proximity with a corresponding rear pleat peak 152 (e.g., in the lateral and/or cross-wise directions 112, 118 of the drape 100). For example, in one embodiment, each front pleat peak 122 may be substantially aligned with a corresponding rear pleat valley 154 in the cross-wise direction 118 of the cellular drape 100 while each front pleat valley 124 may be substantially aligned with a corresponding rear pleat peak 152 in the cross-wise direction 118 of the cellular drape 100. Alternatively, the corresponding pleat peaks 122, 152 and valleys 124, 154 may be slightly offset from each other in the cross-wise direction 118.

Figure 6:
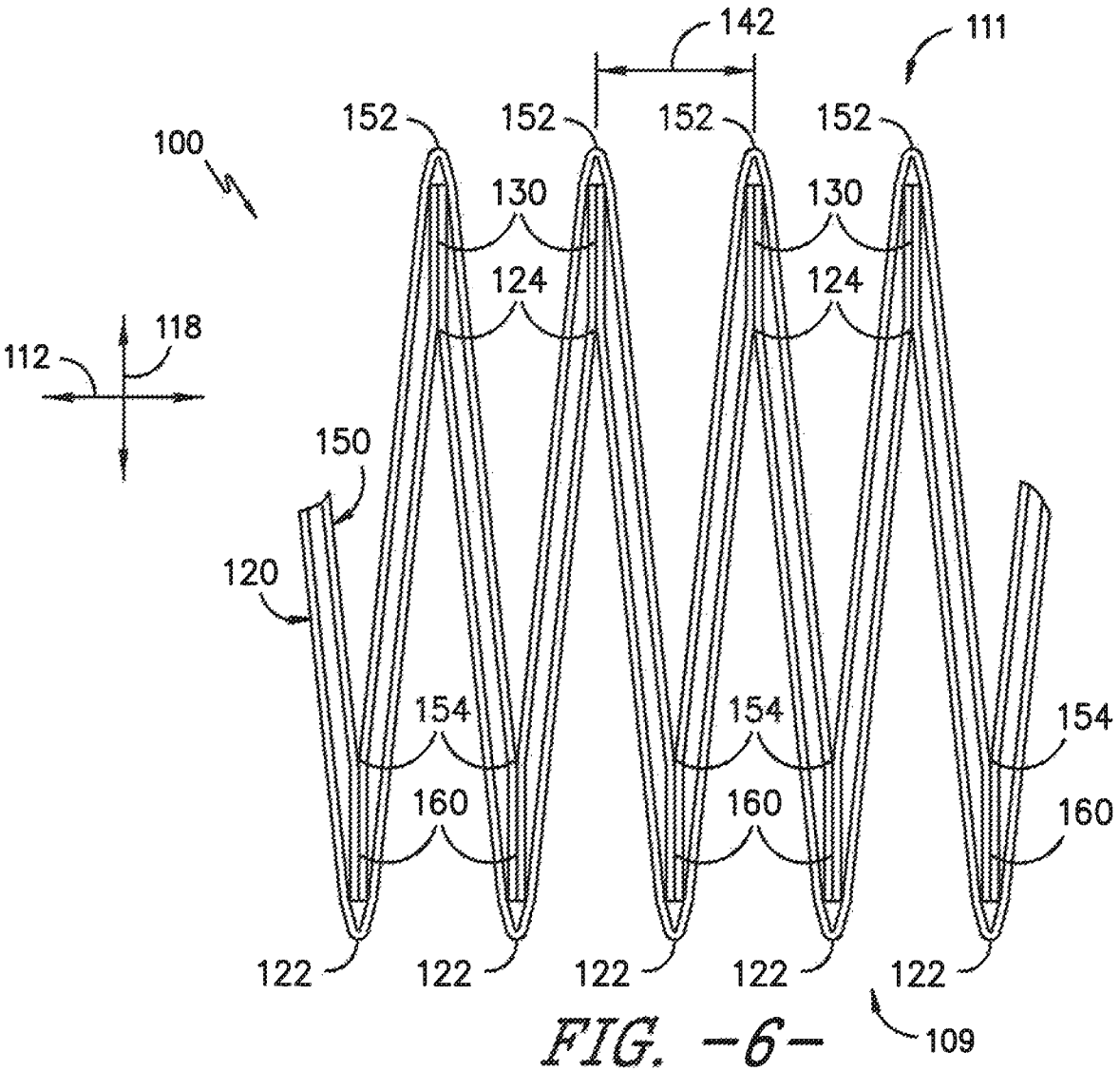
FIG. 6 illustrates a cross-sectional view of the cellular drape shown in FIG. 2 taken about line VI-VI.

It should be appreciated that the interleaved pleat configuration described herein may facilitate folding or stacking of the front and rear drape panels 120, 150 relative to each other when the cellular drape 100 is moved to the retracted position. For instance, as shown in FIG. 6, given the interleaved pleat configuration, each pair of corresponding front pleat peaks 122 and rear pleat valleys 154 and each pair of corresponding front pleat valleys 124 and rear pleat peaks 152 may be configured to take on a nesting positioned relationship relative to each other (e.g., each pleat valley 124, 154 may be nested relative to each corresponding pleat peak 152, 122) when the cellular drape 100 is moved to the retracted position to allow the drape 100 to take on the folded or accordion-style configuration. Additionally, as will be described below, the interleaved pleat configuration may also facilitate formation of the vertically oriented internal cells 115 of the cellular drape 100 when the drape 100 is moved to the extended position.

Additionally, the cellular drape 100 includes a plurality of vertically oriented, internal tabs or ribs extending between the front and rear drape panels 120, 150. Specifically, in several embodiments, each internal rib may be configured to extend in the cross-wise direction 118 of the cellular drape 100 between a corresponding pair of pleat peaks and valleys 122, 124, 152, 154 of the front and rear drape panels 120, 150. For instance, in one embodiment, each drape panel 120, 150 may include an internal rib extending generally in the cross-wise direction 118 of the cellular drape 100 from each of its pleat valleys 124, 154 towards the opposed drape panel 120, 150. In particular, as shown in FIGS. 3-5, the front drape panel 120 includes a plurality of front internal ribs 130 extending in the cross-wise direction 118 towards the rear drape panel 150, with each front internal rib 130 extending inwardly from one of the front pleat valleys 124 towards the corresponding rear pleat peak 152 of the rear drape panel 150. Similarly, as shown in FIGS. 3-5, the rear drape panel 150 includes a plurality of rear internal ribs 160 extending in the cross-wise direction 118 towards the front drape panel 120, with each rear internal rib 160 extending inwardly from one of the rear pleat valleys 154 towards the corresponding front pleat peak 122 of the front drape panel 120. As shown in FIG. 3, in one embodiment, the front internal ribs 130 may be offset from the rear internal ribs 160 in the crosswise direction 118, with the front internal ribs 130 being generally aligned with one another along a plane defined in the lateral direction 112 and the rear internal ribs 160 being generally aligned with one another along a different, spaced apart plane defined in the lateral direction 112.

In several embodiments, each internal rib 130, 160 may serve as a stiffening or structural member for its respective drape panel 120, 150. For instance, in one embodiment, each internal rib 130, 160 may extend lengthwise along the entire vertical height of the cellular drape 100, such as from the top end 108 of the drape 100 to the bottom end 110 of the drape 100. As such, the internal ribs 130, 160 may provide increased stiffness in the vertical direction 106 of the cellular drape 100, thereby allowing the relative positioning and/or shapes of the drape panels 120, 150 to be maintained along the vertical height or length of the drape 100. In addition, the internal ribs 130, 160 may be configured to serve as cross-wise spacers for the cellular drape 100. For instance, each internal rib 130, 160 may function to maintain a given cross-wise spacing between the drape panels 120, 150, thereby allowing each internal cell 115 to have a minimum cross-wise depth when the drape 100 is moved to the extended position. Specifically, in one embodiment, each internal rib 130, 160 may extend outwardly towards the opposed pleat peak 122, 152 of the adjacent drape panel 120, 150 so that, when the cellular drape 100 is moved to the extended position, each internal rib 130, 160 may, for example, contact the adjacent side of the opposed pleat peak 122, 152 to set the minimum cross-wise spacing for the drape panels 120, 150. As such, the ribs 130, 160 may assist in forming and maintaining the desired shape of the internal cells 115 (and the cellular drape 100 as a whole) when the drape 100 is moved to the extended position. Such spacing may, for example, provide numerous advantages including, but not limited to, enhanced light diffusion between the front and rear drape panels 120, 150, improve heat transfer via conduction or convection, and enhanced sound damping. Moreover, given the positioning of the internal ribs 130, 160 relative to the opposed pleat peaks 122, 152 of the adjacent drape panel 120, 150, the ribs 130, 160 may also be configured to nest within the inner side of the opposed pleat peak 122, 152 when the drape 100 is moved to the retracted position, thereby allowing the cellular drape 100 to be folded into its collapsed, accordion-style configuration (e.g., as shown in FIG. 6).

It should be appreciated that, in one embodiment, the front and rear drape panels 120, 150 may be formed from the same material. Alternatively, the front drape panel 120 may be formed from a material that differs from the material used to form the rear drape panel 150. For example, in one embodiment, the front drape panel 120 may be made from a material that does not permit significant amounts of light to pass through the material, while the rear drape panel 150 may be made from a material that allows much larger quantities of light to pass through the material. In this manner, the front face 109 of the cellular drape 100 may appear to illuminate when the drape 100 is in the extended position and light is striking the rear face 111 of the drape 100. Alternatively, the rear drape panel 150 may be made from a room-darkening or blackout material. Similarly, when the front drape panel 120 defines the side of the cellular drape 100 facing the interior of the room within which the drape 100 is installed (e.g., the front face or side 109), the front drape panel 120 may, for example, be formed from a material having an aesthetically pleasing design or texture. In such an embodiment, since the rear drape panel 150 may not be typically viewed, the rear drape panel 150 may be formed from a material that is less ornate and, thus, less expensive, thereby reducing the overall cost of manufacturing the cellular drape 100.

It should also be appreciated that, in several embodiments, each drape panel 120, 150 may be formed from separate strips or webs of material. For instance, FIG. 4 illustrates an enlarged view of a portion of the cellular drape 100 shown in FIG. 3 in which the front and rear drape panels 120, 150 are formed from separate vertical strips or webs of materials. As shown in FIG. 4, the front drape panel 120 is formed from separate, vertical extending front webs 132 coupled end-to-end across the width of the panel 120 so that each front web 132 defines one of the front pleat peaks 122 of the front drape panel 120 and also forms the first and second wall sections 126, 128 extending from the pleat peak 122. In such an embodiment, opposed lateral edges or ends 134 of each front web 132 may be coupled to the lateral edges or ends 134 of adjacent front webs 132 at each front pleat valley 124. For instance, as shown in FIG. 4, the front internal rib 130 extending from each front pleat valley 124 may be formed by coupling the adjacent lateral ends 134 of the front webs 132 to each other (e.g., by applying an adhesive at an interface 135 defined between abutting, outer surfaces of the front webs 132 defined at the adjacent lateral ends 134, with the lateral ends 134 being subsequently pinched or pressed together to form the rear internal rib 160 at such interface 135) so that each front internal rib 130 corresponds to or defines a joint or junction line between adjacent front webs 132 of the front drape panel 120. Similarly, as shown in FIG. 4, the rear drape panel 150 may be formed from separate, vertical extending rear webs 162 coupled end-to-end across the width of the panel 150 so that each rear web 162 defines one of the rear pleat peaks 152 of the rear drape panel 150 and also forms the first and second wall sections 156, 158 extending from the pleat peak 152. In such an embodiment, the opposed lateral edges or ends 164 of each rear web 162 may be coupled to the lateral edges or ends 164 of adjacent rear webs 162 at each rear pleat valley 154. For instance, as shown in FIG. 4, the rear internal rib 160 extending from each rear pleat valley 154 may be formed by coupling the adjacent lateral ends 164 of the rear webs 162 to each other (e.g., by applying an adhesive at an interface 165 defined between abutting, outer surfaces of the front webs 162 defined at the adjacent lateral ends 164, with the lateral ends 164 being subsequently pinched or pressed together to form the rear internal rib 160 at such interface 165) so that each rear internal rib 160 corresponds to or defines a joint or junction line between adjacent rear webs 162 of the rear drape panel 150.

Figure 8:
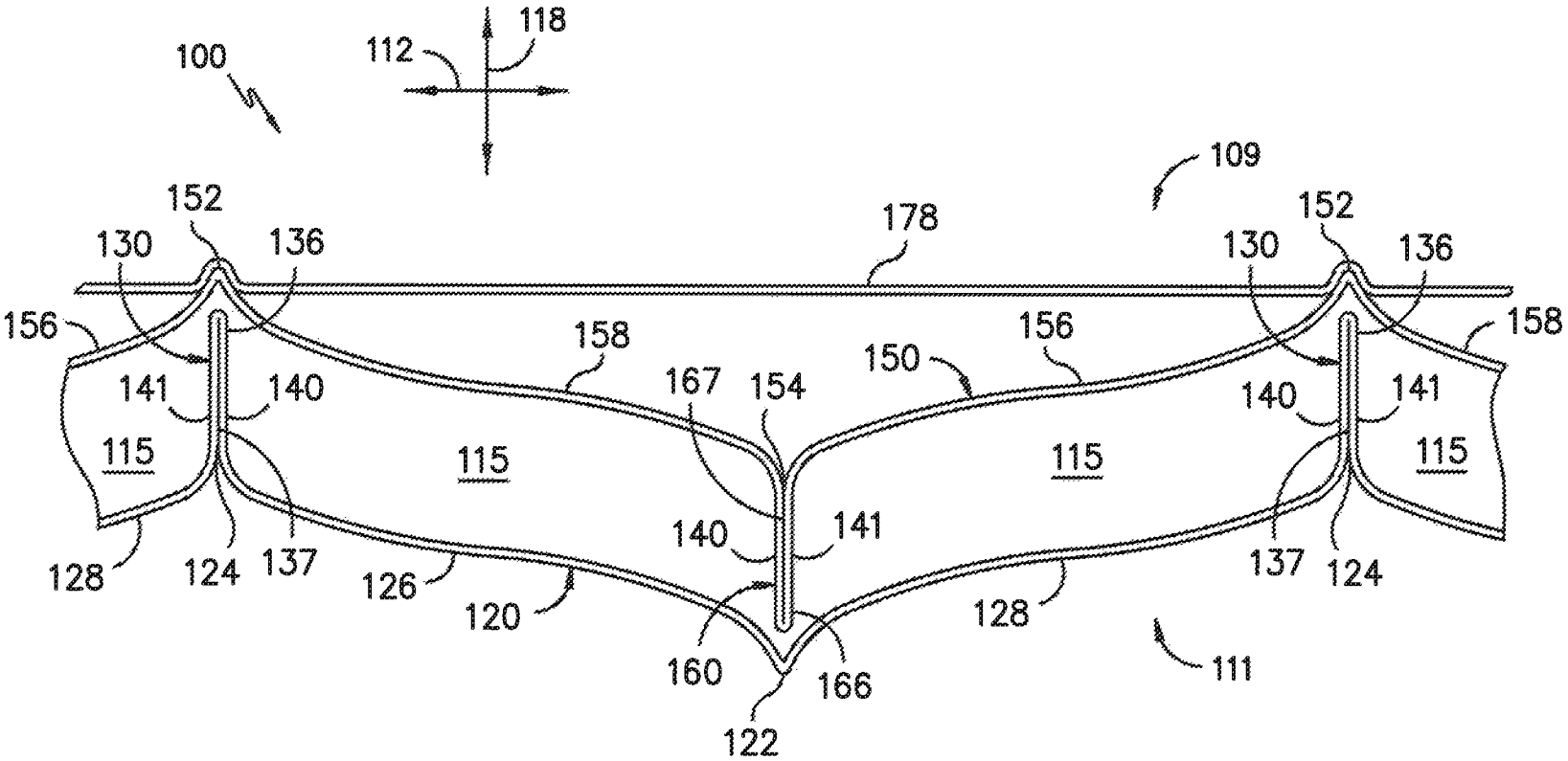
FIG. 8 illustrates a similar cross-sectional view of the cellular drape as shown in FIG. 4, particularly illustrating another embodiment of a suitable drape configuration for the cellular drape.

Alternatively, each drape panel 120, 150 may be formed as a continuous sheet of material. For example, FIG. 8 illustrates a cross-sectional view of another embodiment of the cellular drape 100 shown in FIG. 4 in which each drape panel 120, 150 is formed from a single continuous sheet of material. As shown in FIG. 8, in such an embodiment, the front internal ribs 130 may be formed from folded or overlapped portions 136 of the continuous sheet of material forming the front drape panel 120. For instance, an adhesive may be applied at an interface 137 defined between the overlapped portions 136, with the overlapped portions 136 being subsequently pinched or pressed together to form the front internal rib 130 at such interface 137. Similarly, the rear internal ribs 160 may be formed from folded or overlapped portions 166 of the continuous sheet of material forming the rear drape panel 150. For instance, an adhesive may be applied at an interface 167 defined between the overlapped portions 166, with the overlapped portions 166 being subsequently pinched or pressed together to form the rear internal rib 160 at such interface 167.

Referring back to FIGS. 1-7, as indicated above, when the cellular drape 100 is moved to its extended position, a plurality of vertically oriented internal cells 115 may be defined between the front and rear drape panels 120, 150, in one embodiment, each internal cell 115 may be defined between the drape panels 129, 150 so as to extend in the lateral direction 112 of the cellular drape 100 between the corresponding pairs of respective pleat peaks and valleys 122, 124, 152, 154 defined by the drape panels 120, 150. For instance, as particularly shown in FIGS. 3-5, each internal cell 115 may extend in the lateral direction 112 between a corresponding pair of pleat peaks/valleys 152, 124 provided at the location of one of the front internal ribs 130 of the front drape panel 120 and an adjacent pair of pleat peaks/valleys 122, 154 provided at the location of the adjacent rear internal rib 160 of the rear drape panel 150. In such an embodiment, the adjacent or neighboring front and rear internal ribs 130, 160 of the drape panels 120, 150 may generally define the opposed lateral ends or sides of each internal cell 115. For instance, as particularly shown in FIG. 4, each internal cell 115 may extend in the lateral direction 112 of the cellular drape 100 between a first lateral side 140 (e.g., the lateral side of each cell 115 positioned closest to the first lateral end 114 of the cellular drape 100) and a second lateral side 141 (e.g., the lateral side of each cell 115 positioned closest to the second lateral end 116 of the cellular drape 100), with the each internal rib 130, 160 generally extending along and/or defining at least a portion of the adjacent lateral sides 140, 141 of each adjacent pair of internal cells 115. Additionally, as shown in FIG. 4, each internal cell 115 may be configured to extend in the cross-wise direction 118 of the cellular drape 100 between the adjacent wall sections 126, 128, 156, 158 of the drape panels 120, 150. For instance, as indicated above, each internal cell 115 may define a cross-wise depth 117 (FIG. 3) between the drape panels 120, 150 in the cross-wise direction 118 of the cellular drape 100.

In several embodiments, each internal cell 115 may be configured to define an angled orientation in the cross-wise direction 118 of the cellular drape 100 when the drape 100 is moved to the extended position. In such embodiments, the extent of the angled orientation defined by each internal cell 115 may vary, for example, based on the degree to which the cellular drape 100 is "extended" or "unfolded" when moved to the extended position from the retracted position. Specifically, as the cellular drape 100 is moved from the retracted position towards the extended position, the cross-wise angular orientation of the internal cells 115 may decrease as the degree of extension of the cellular drape 100 increases. For example, when the drape 100 is moved to the extended position shown in FIGS. 3-5, each internal cell 115 may generally define a given angled orientation in the cross-wise direction 118 of the cellular drape 100 as each cell 115 extends laterally from its first lateral side 140 to its second lateral side 141. However, as the drape 100 is further extended from the configuration shown in FIGS. 3-5, the angled orientation of the internal cells 115 in the cross-wise direction 118 may be decreased. For example, as shown in FIG. 7, by increasing the lateral tension in the cellular drape 100, the internal cells 115 may define a more planar orientation relative to the cross-wise direction 118 of the cellular drape 100 as each internal cell 115 extends laterally from its first lateral side 140 to its second lateral side 141.

It should be appreciated that, in one embodiment, the degree of extension of the cellular drape 100 may be defined or represented by a peak-to-peak distance defined between adjacent pleat peaks 122 of the front drape panel 120 or adjacent pleat peaks 152 of the rear drape panel 150. For instance, as shown in FIG. 3, a peak-to-peak distance 142 may be defined between each pair of adjacent rear pleat peaks 152. In such an embodiment, as the peak-to-peak distance 142 is decreased from that shown in FIG. 3 when moving the cellular drape 100 towards its retracted position, the angled orientation of the internal cells 115 in the cross-wise direction 118 may be increased as the drape panels 120, 150 take on a more folded configuration. For instance, as shown in FIG. 6, when the peak-to-peak distance 142 is relatively small due to the folded nature of the cellular drape 100 in the retracted position, the angular orientation of the internal cells 115 (or the angular orientation of the front and rear drape panels 120, 150 to the extent that the drape panels 120, 150 are no longer spaced apart from each other to define the cells 115 therebetween) may be increased or may otherwise become much sharper in the cross-wise direction 118 than that shown in FIG. 3. Similarly, as the peak-to-peak distance 142 is increased from that shown in FIG. 3 as the cellular drape 100 is further extended, the angular orientation of the internal cells 115 in the cross-wise direction 118 may be decreased. For instance, as shown in FIG. 7, when the peak-to-peak distance 142 is increased, the angular orientation of the internal cells 115 may decrease or may otherwise become much more planar in the cross-wise direction 118 than that Shown in FIG. 3.

It should also be appreciated that, when the cellular drape 100 is collapsed into its folded or accordion-style configuration in the retracted position (e.g., as shown in FIG. 6), the peak-to-peak distance 142 for the drape 100 may be significantly reduced as compared to the peak-to-peak distance 142 for the drape 100 when in the extended position. For instance, in one embodiment, for every foot the cellular drape 100 extends in the lateral direction 112 when in the extended position, the drape may be reduced to a lateral width of less than one inch when in the retracted position. For instance, in a particular embodiment, when the cellular drape 100 is moved to the retracted position, the peak-to-peak distance 142 may be less than 0.5 inch, such as less than 0.4 inches, or less than 0.3 inches, or less than 0.2 inches or less than 0.10 inches and/or any other subranges therebetween (including variations of such values with increments of +/−0.05 inches). However, it be appreciated that the peak-to-peak distance 142 in the retracted position may generally vary based on, for example, the configuration of the support structure 104, the material properties of the drape 100 and/or the like.

Additionally, in several embodiments, adjacent internal cells 115 of the vertical drape 100 may be configured to define alternating angled orientations between their first and second lateral sides 140, 141 in the cross-wise direction 118 of the drape 100. For example, when the drape 100 is moved to the extended position as shown in FIGS. 3-5, each internal cell 115 may define a cross-wise angular orientation from its first lateral side 140 to its second lateral side 141 that is generally directed towards one of the front face 109 or the rear face 111 of the cellular drape 100, with each immediately adjacent cell 115 defining a cross-wise angular orientation from its first lateral side 140 to its second lateral side 141 that is generally directed in the opposite cross-wise direction (e.g., towards the other of the front face 109 or the rear face 111 of the cellular drape 100). For instance, as particularly shown in FIG. 4, each internal cell 115 having its first lateral side 140 (i.e., the side closest to the first lateral end 114 of the cellular drape 100) formed at least partially by one of the front ribs 130 generally defines a first angled orientation (e.g., as indicated by first cell reference line 144) extending from its first lateral side 140 to its second lateral side 141 that is directed or angled towards the front face 109 of the cellular drape 100 while each internal cell 115 having its first lateral side 140 formed at least partially by one of the rear ribs 160 generally defines an opposed, second angled orientation (e.g., as indicated by second cell reference line 145) extending from its first lateral side 140 to its second lateral side 141 that is directed or angled towards the rear face 111 of the cellular drape 100. This pattern of alternating angled orientations may be repeated in the lateral direction 112 of the cellular drape 100 (e.g., as shown in FIG. 3) such that each internal cell 115 having the first angled orientation 144 is positioned end-to-end with adjacent internal cells 115 having the second angled orientation 145.

In several embodiments, the cell reference lines 144, 145 shown in FIG. 4 as being generally representative of the cross-wise angular orientations of the internal cells 115 may be defined as straight lines extending between corresponding pairs of reference points 146 defined along the opposed lateral sides 140, 141 of the internal cells 115. Specifically, a reference point 146 may be defined along each lateral side 140, 141 of the internal cells 115 (e.g., at the interface between adjacent internal cells 115) at a common cross-wise location defined between the front and rear faces 109, 111 of the cellular drape 100. For instance, in the embodiment shown in FIG. 4, each reference point 146 is defined at a central location between the front and rear faces 109, 111 such that the reference points 146 are generally spaced apart from each adjacent pair of corresponding pleat peaks/valleys 122, 124, 152, 154 of the front and rear drape panels 120, 150 by equal cross-wise distances. In such an embodiment, each orientation reference line 144, 145 may be defined as a straight line extending between each corresponding pair of adjacent, centrally located reference points 146. However, in other embodiments, the reference points 146 may be defined along each lateral side 140, 141 of the internal cells 115 at any other suitable corresponding or matching cross-wise locations. For instance, as opposed to being centrally located, each reference point 146 may be defined along the adjacent lateral side 140, 141 of each internal cell 115 so as to be spaced apart from the front face 109 or the rear face 111 of the cellular drape 100 by the same cross-wise distance as every other reference point 146, such as by defining each reference point 146 at each front pleat peak 122 and front pleat valley 124 along the front face 109 of the cellular drape 100 or by defining each reference point 146 at each rear pleat peak 152 and rear pleat valley 154 along the rear face 111 of the cellular drape 100.

In one embodiment, a cross-wise angle may be defined by each cell reference line 144, 145 relative to the lateral direction 112 of the cellular shade 100 that is generally indicative of the degree or magnitude of the angular orientation of each corresponding internal cell 115 in the cross-wise direction 118. As indicated above, the degree or magnitude of the angular orientation of each internal cell 115 may generally vary depending on the extent to which the cellular drape 100 is extended. For instance, as shown in FIG. 7, when the cellular drape 100 is further extended from the configuration shown in FIG. 3, the internal cells 115 may be configured to define a more planar, less staggered cross-wise profile. However, in general, with reference to the embodiment shown in FIG. 4, each internal cell 115 having the first angled orientation 144 may define a positive cross-wise angle 170 relative to the lateral direction 112 of the cellular drape 100 while each internal cell 115 having the second angled orientation 145 may generally define a negative cross-wise angle 172 relative to the lateral direction 112 of the cellular drape 100. In such an embodiment, a positive cross-wise angle 170 generally indicates that the associated internal cell 115 extends from its first lateral side 140 to its second lateral side 141 along a reference line 144 that is angled towards the front face 109 of the cellular drape 100 (e.g., having an angular component extending in a first cross-wise direction 174 (FIG. 4) directed towards the front face 109) while a negative cross-wise angle 172 generally indicates that the associated internal cell 115 extends from its first lateral side 140 to its second lateral side 141 along a reference line 145 that is angled towards the rear face 111 of the cellular drape 100 (e.g., having an angular component extending in a second cross-wise direction 176 (FIG. 4) directed towards the rear face 111).

It should be appreciated that, when the cellular drape 100 is moved to the extended position shown in FIGS. 3-5, the alternating angular orientations of the internal cells 115 may provide the drape 100 with a zigzagged, pleated and/or staggered cross-wise profile extending between the first and second lateral ends 114, 116 of the drape 100. In such an embodiment, the opposed angular orientations of each pair of adjacent internal cells 115 may allow the adjacent pairs of internal cells 115 to define a chevron or chevron-like shape. For instance, as shown in the example of FIG. 4, the two internal cells 115 disposed along either side of the illustrated rear internal rib 160 collectively may form a forwardly-directed chevron shape, with the tip end or peak of the chevron shape being formed by the adjacent forward pleat peak 122. Similarly, each pair of internal cells 115 disposed along either side of each front internal rib 120 may be configured to collectively form a rearwardly-directed chevron shape, with the tip end or peak of the chevron shape being formed by the adjacent rear pleat peak 160.

It should also be appreciated that, in several embodiments, the cellular drape 100 may be configured to define a maximum peak-to-peak distance when in the extended position to allow the internal cells 115 to take on or otherwise define a desired angular orientation, thereby allowing the cellular drape 110 to be provided with a predetermined amount of fullness or cross-wise depth. In such embodiment, the maximum peak-to-peak distance may be defined using components or features of the support structure 104 associated with the cellular drape 100 or by configuring the cellular drape 100, itself, to only be extended from the retracted position to an extended position at which the peak-to-peak distance 142 is equal to the desired maximum value. For instance, when the cellular drape 100 is suspended via hangers 105, the maximum lateral spacing defined between the hangers 105 when the drape 100 is moved to the extended position may be limited using suitable spacers, limiter, connecting links, or other suitable structure to prevent the peak-to-peak distance 142 for the cellular drape 100 from being increased beyond the predetermined maximum distance. In another embodiment, connecting links may be coupled between separate portions of the front drape panel 120 or the rear drape panel 150 to set the maximum peak-to-peak distance. For instance, as shown in FIG. 8, a continuous strip of material or separate strips material 178 may be coupled laterally across each pair of adjacent rear pleat peaks 152. In such an embodiment, the length of the strip of material 178 (or the portion of the strip of material) extending laterally between each pair of adjacent rear pleat peaks 152 may define the maximum lateral spacing between the adjacent pleat peaks 152 and, thus, may set the maximum peak-to-peak distance for the cellular drape 100.

Referring back to FIGS. 1-7, it should be appreciated that, depending on the configuration of the cellular drape 100 and/or the degree to which the drape 100 is extended while in its extended position (e.g., based on the peak-to-peak distance 142) each internal cell 115 may, in certain embodiments, be at least partially interconnected with adjacent cells 115 in the lateral direction 112 of the cellular drape 100 or the internal cells 115 may be closed off or isolated from one another. For instance, as will be described below, in one embodiment, the front and rear drape panels 120, 150 may not be directly coupled to one another along the vertical height or length of the cellular drape 100. In such an embodiment, based on the configuration of the internal ribs 130, 160 and/or the extent to which the cellular drape 100 is extended, a gap may be defined between one or more of the ribs 130, 160 and the opposed drape panel 120, 150 that interconnects one or more of the internal cells 115 with one or more adjacent internal cells 115. For instance, as shown in FIG. 4, a front gap 138 may be defined between each rear rib 160 and the adjacent front pleat peak 122 of the front drape panel 120 that interconnects the internal cells 115 defined along either side of the rear rib 130. Similarly, as shown in FIG. 4, a rear gap 168 may be defined between each front rib 130 and the adjacent rear pleat peak 152 that interconnects the internal cells 115 defined along either side of the front rib 130. However, in other embodiments, such gap(s) 138, 168 may not be present when the cellular drape 100 is moved to the extended position, depending on the configuration of the drape panels 120, 150 and the amount of force/tension applied through the drape 100. Alternatively, as will be described below with reference to FIGS. 11-17, the cellular drape 100 may, instead, include front and rear drape panels 120, 150 that are coupled to one another vertically from the top end 108 to the bottom end 110 of the cellular drape 100 along the lateral sides of each internal cell 115. In such an embodiment, each internal cell 115 may define a closed cell configuration and may be isolated from adjacent internal cells 115 in the lateral direction 112 of the cellular drape 100.

Additionally, in several embodiments, the cellular drape 100 includes a plurality of headers coupled between the drape panels 120, 150 at or adjacent to the top end 108 of the drape 100. For example, as particularly shown in FIG. 5, in one embodiment, the cellular drape 100 may include a plurality of looped headers 180 coupled between the drape panels 120, 150, with each header 180 extending across a pair of adjacent internal cells 115. Specifically, as shown in FIG. 5, each header 180 may include first and second looped portions 194, 196 positioned within adjacent internal cells 115 of the cellular drape 100 and a connecting portion 198 extending between the first and second looped portions 194, 196 across the interface define between the adjacent lateral sides of the neighboring internal cells 116. In such an embodiment, the connecting portion 198 may, for example, be configured to extend between the internal rib 130, 160 extending in the cross-wise direction 118 between the adjacent internal cells 115 towards the corresponding pleat peak 122, 152 of the opposed drape panel 120, 150. For instance, as shown in FIG. 5, the connecting portion 198 extends from the first looped portion 194 to the second looped portion 196 between the adjacent rear rib 160 of the rear drape panel 150 and the corresponding front pleat peak 122 of the front drape panel 120.

Additionally, opposed sides or walls of each looped portion 194, 196 may be coupled to the adjacent wall sections 126, 128, 156, 158 of the drape panels 120, 150. For instance, as shown in FIG. 5, each looped portion 194, 196 may include a front wall 182 configured to be coupled to an adjacent wall section 126, 128 of the front drape panel 120 and a rear wall 184 configured to be coupled to an adjacent wall section 156, 158 of the rear drape panel 150, thereby allowing each header 180 to be secured between the drape panels 120, 150. In such an embodiment, the front and rear walls 182, 184 of each lopped portion 194, 196 may, for example, be coupled to the front and rear drape panels 120, 150 along all or a substantial portion of the outer perimeter of each internal cell 115 defined by the drape panels 120, 150. It should be appreciated that the opposed walls 182, 184 of each header 180 may be coupled between the drape panels 120, 150 at the top end 108 of the cellular drape 100 using any suitable attachment means and/or method, such as adhesive(s), sewing, weaving, mechanical fasteners, etc.

In several embodiments, each header 180 may be formed from a material that is more stiff or rigid than the material used to form the front and rear drape panels 120, 150. As such, the headers 180 may be configured to serve as structural or support members for the cellular drape 100. For instance, as will be described below, the headers 180 may be used as the primary attachment structure for coupling the cellular drape 100 to its associated support structure 104 and/or for coupling the drape panels 120, 150 to each other. In addition to being relatively stiff, the material selected for the headers 180 may also be relatively resilient to allow the headers 180 to spring or flex into the opened or looped configuration shown in FIG. 5 when the cellular drape 100 is moved to the extended position as opposed to the closed or flattened configuration taken by the headers 180 when the drape 100 is moved to the retracted position. Such resiliency of the headers 180 may assist in forming and/or maintaining the shape of the internal cells 115 between the drape panels 120, 150 as the cellular drape 100 is being extended. For example, by springing or flexing into the opened or looped configuration, the headers 180 may push the front and rear drape panels 120, 150 apart from each other so that the various internal cells 115 are defined between the drape panels 120, 150 in the cross-wise direction 118 of the cellular drape 100.

It should be appreciated that, in general, the headers 180 may be formed from any suitable material(s) that exhibits suitable material properties to allow the headers 1180 to function as described herein. In one embodiment, suitable materials for the headers 180 may include, but are not limited to, stiffened header fabrics typically used in the industry (e.g., crinoline), materials that have been coated or impregnated with plastic, woven materials, plastic materials (e.g., polyester, polyethylene, nylon film, polypropylene, polyvinyl chloride, and polycarbonate), cardboard, and/or the like.

As shown in FIG. 5, in one embodiment, the front and rear walls 182, 184 of each header 180 may be configured to extend between opposed fold or crease lines 186. In such an embodiment, when the cellular drape 100 is moved towards the retracted position from the extended position, the crease lines 186 may allow each header 180 to collapse into its flattened or closed configuration, thereby allowing the cellular drape 100 to assume the folded or accordion-style configuration described above with reference to FIGS. 2 and 6. However, as indicated above, when the cellular drape 100 is moved to the extended position, the material properties of the header material may allow for the front and rear walls 182, 184 of the header 180 to spring outwardly or expand relative to each other about the crease lines 186 into the opened configuration shown in FIG. 5 to facilitate formation of the internal cells 115.

In several embodiments, the headers 180 may correspond to the primary attachment structure for coupling the front drape panel 120 to the rear drape panel 150. For instance, in the embodiment shown in FIGS. 1-7, the front drape panel 120 is only configured to be coupled to the rear drape panel 150 at the top end 108 of the cellular drape 100 via the headers 180 (e.g., via the connection provided between the opposed front and rear walls 182, 184 of the header 180). In such an embodiment, the front and rear drape panels 120, 150 may be suspended from the headers 180 such that the drape panels 120, 150 simply hang relative to each other along a substantial portion of the vertical length of the cellular drape 100. For instance, as shown in FIG. 1, the front and rear drape panels 120, 150 may be suspended from the headers 180 such that the cellular drape 100 defines a vertical suspension distance 188 between the headers 180 and its bottom end 110 along which the drape panels 120, 150 are not coupled to each other and simply hang from the headers 180 relative to each other. It should be appreciated that the connection provided by the headers 180 may serve to bias the front and rear drape panels 120, 150 away each other along the vertical suspension distance 188 when the cellular drape 100 is moved to the extended position. In addition, the structural stiffness provided by the internal ribs 130, 160 of the drape panels 120, 150 may serve to assist in maintaining the relative positioning of the drape panels 120, 150 along the vertical suspension distance 188 while also providing structure to set the cross-wise spacing between the drape panels 120, 150.

Figure 9:
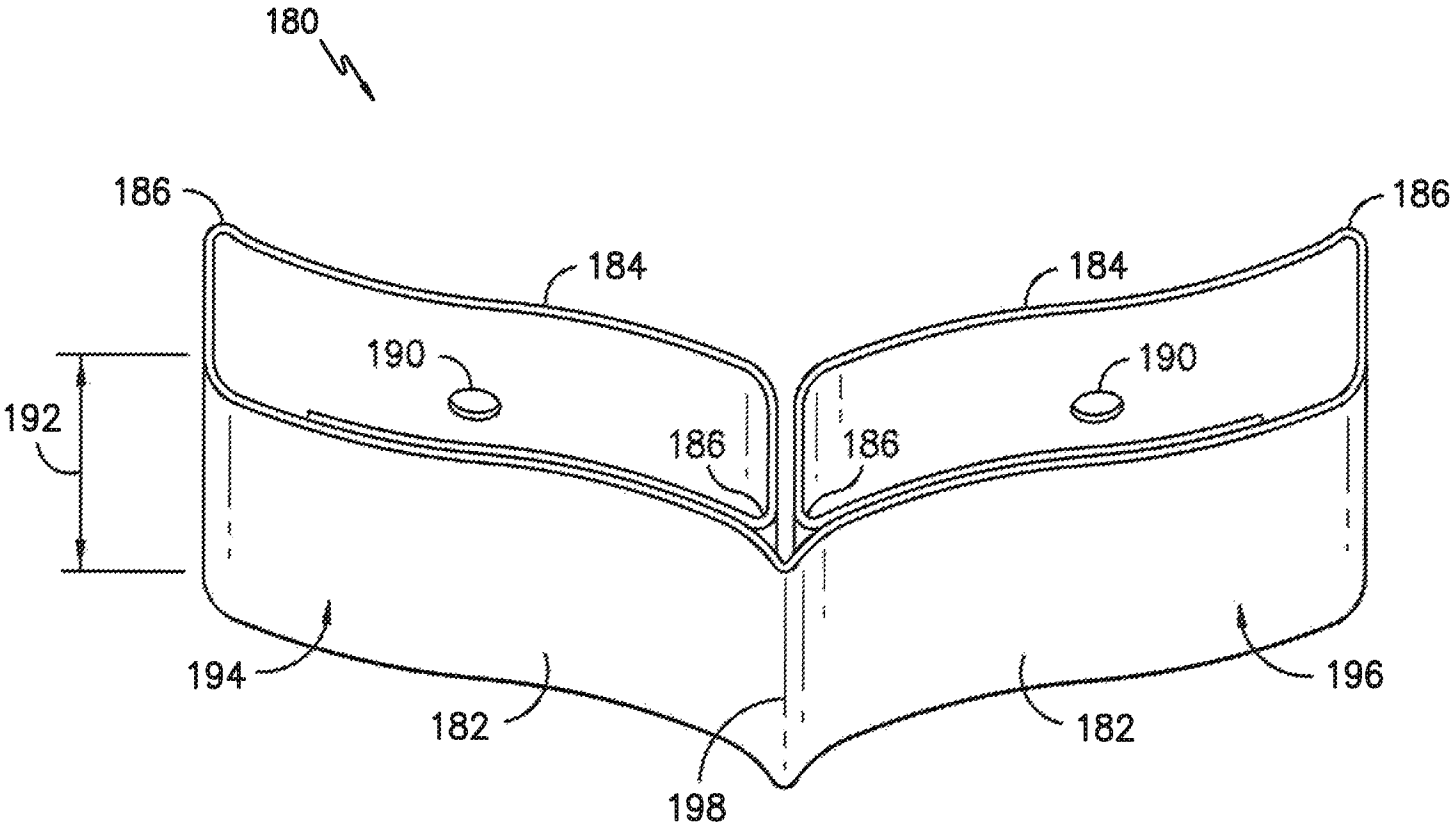
FIG. 9 illustrates a perspective view of one embodiment of a header suitable for use within the disclosed cellular drape in accordance with aspects of the present subject matter.

Additionally, as indicated above, the headers 180 may, in one embodiment, correspond to the primary attachment structure for coupling the cellular drape 100 to its associated vertical support structure 104. For example, FIG. 9 illustrates a perspective view of one of the headers 180 shown in FIGS. 1 and 5. As shown in FIG. 9, in one embodiment, each header 180 may include one or more slots or openings 190 configured to receive portions of the hangers 105 or other attachment structure configured to facilitate suspending the cellular drape 100 from the support structure 104. In such an embodiment, it may be desirable to position the slots or openings 190 along the rear walls 184 of the header 180 to allow the attachment point defined between the cellular drape 100 and the support structure 104 to be located along the rear side of the drape 100.

It should be appreciated that FIG. 9 also illustrates a vertical dimension or height 192 of the headers 180. In several embodiments, the height 192 of each header 180 may be relatively small compared to the overall height of the cellular drape 100. For instance, in one embodiment, the height 192 of each header 180 may be greater than about 0.5 inch to about 1.5 inches (e.g., in 0.1 inch increments) and less than about 4 inches to about 2.5 inches (e.g., in 0.1 inch increments).

Figure 10:
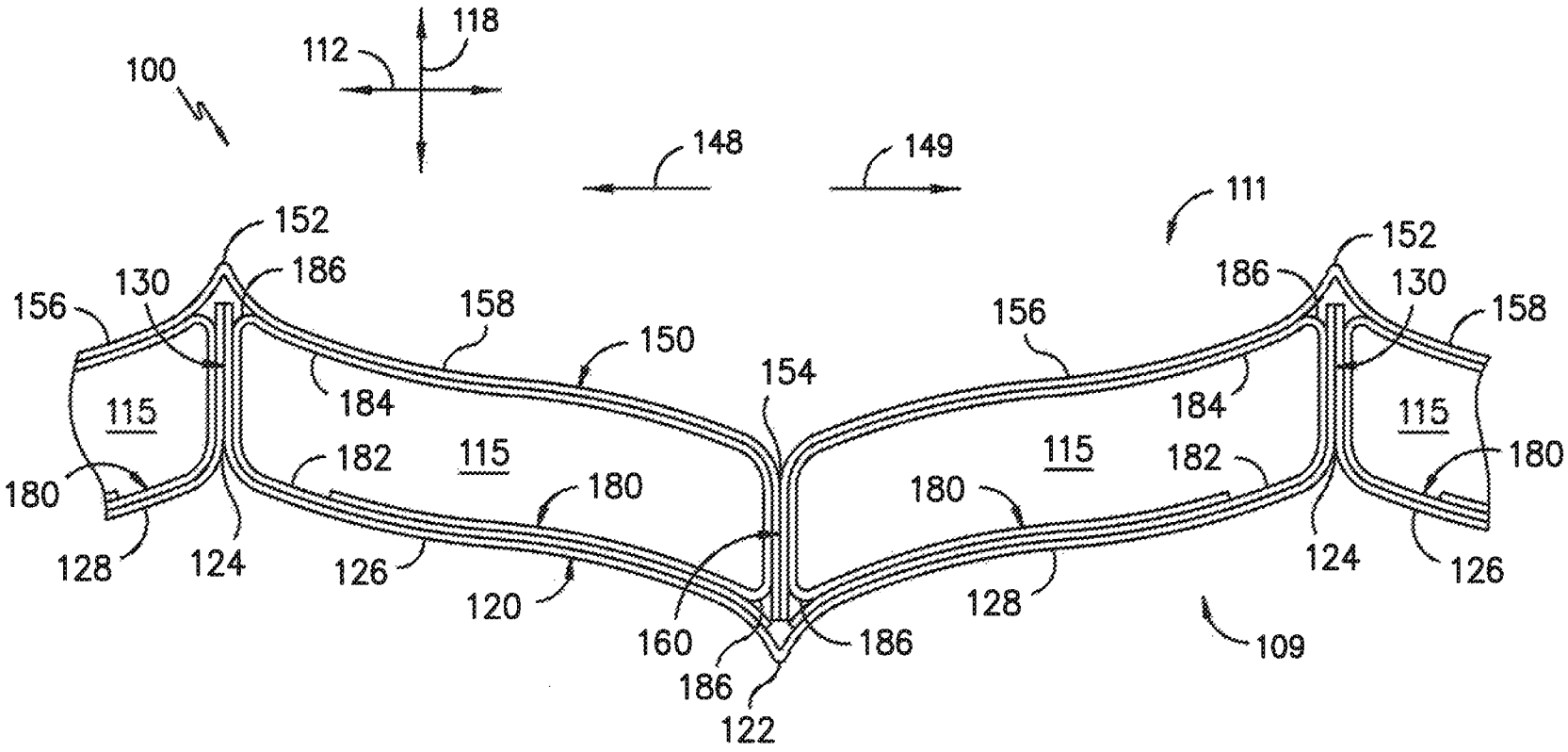
FIG. 10 illustrates a similar cross-sectional view of the cellular drape as shown in FIG. 5, particularly illustrating another embodiment of a suitable header configuration for the cellular drape.

It should also be appreciated that, in the embodiment shown in FIGS. 1, 5, and 9, the cellular drape 100 includes a header 180 for each pair of adjacent internal cells 115 defined between the front and rear drape panels 120, 150. In alternative embodiments, the cellular drape 100 may include a single header 180 positioned with each internal cell 115 defined between the front and rear drape panels 120, 150. For instance, FIG. 10 illustrates a cross-sectional view of another embodiment of the cellular drape 100 shown in FIG. 5, particularly illustrating an embodiment in which each header 180 is positioned within a single internal cell 115 of the cellular drape 100. In such an embodiment, similar to the embodiment described above with reference to FIG. 5, opposed sides or walls of each header 180 may be configured to be coupled to the adjacent wall sections 126, 156, 156, 158 of the drape panels 120, 150. For instance, as shown in FIG. 10, a front wall 182 of each header 180 may be coupled to the adjacent wall section 126, 128 of the front drape panel 120 forming the front side or wall of the corresponding internal cell 115 while a rear wall 184 of each header 180 may be coupled to the adjacent wall section 156, 158 of the rear drape panel 150 forming the rear side or wall of such internal cell 115. Similar to the header embodiment described above with reference to FIG. 5, the headers 180 shown in FIG. 9 may, for example, correspond to the only attachment structure provided between the drape panels 120, 150. Moreover, as shown in FIG. 9, the front and rear walls 182, 184 of each looped portion 194, 196 may extend laterally between opposed fold or crease lines 186. Such crease lines 186 may allow each header 180 to collapse or otherwise take on a flat or closed configuration when the cellular drape 100 is moved to the retracted position from the extended position.

Figure 11:
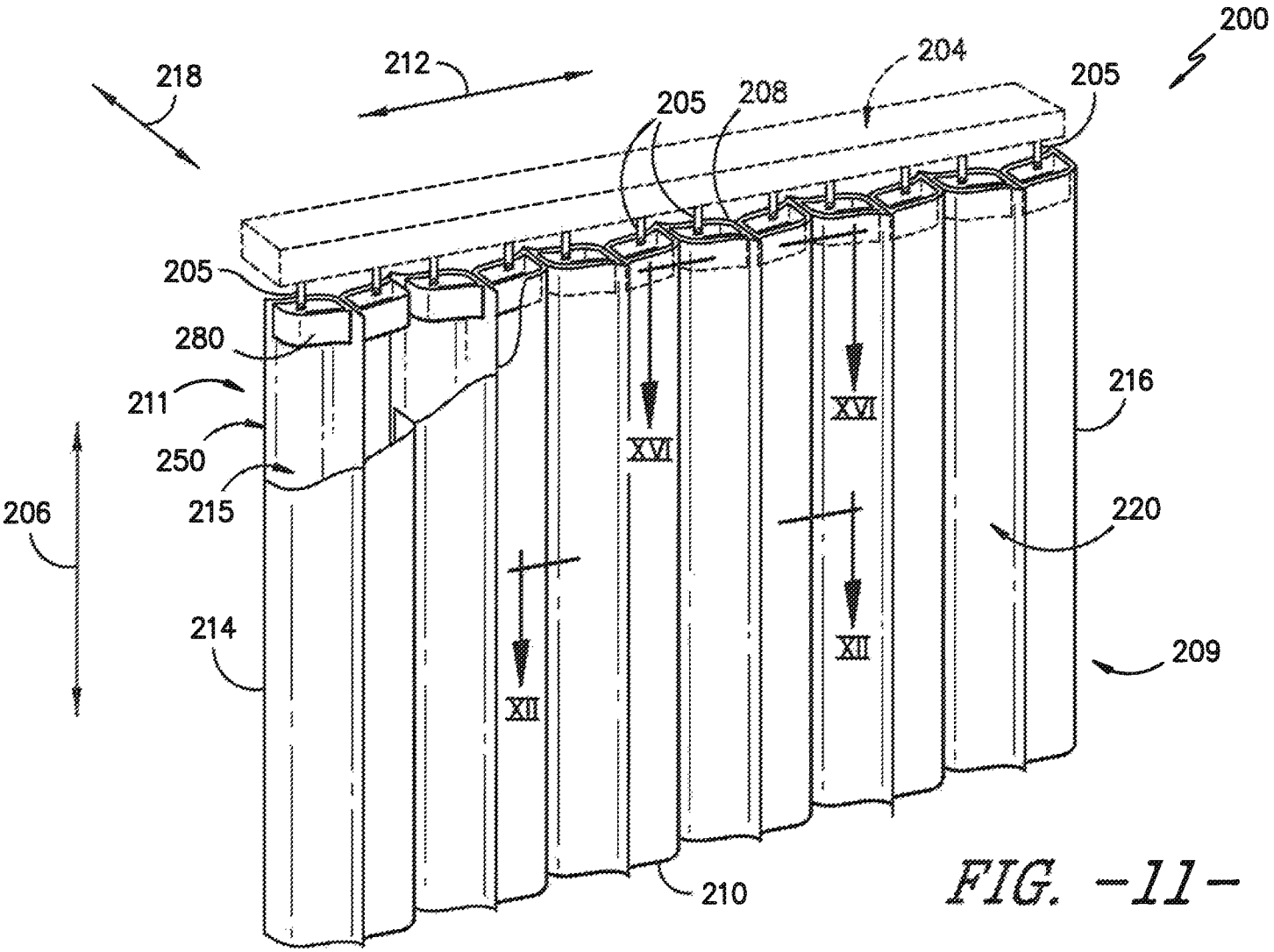
FIG. 11 illustrates a perspective view of another embodiment of a vertical cellular drape in accordance with aspects of the present subject matter, particularly illustrating the cellular drape in an extended position relative to an adjacent architectural structure (not shown) and also illustrating an upper corner of a front drape panel of the cellular drape cut-away to show a portion of a rear drape panel of the cellular drape extending behind the front drape panel.

Referring now to FIGS. 11-17, another embodiment of a vertical cellular drape 200 configured for use as a covering for an architectural structure is illustrated in accordance with aspects of the present subject matter. In general, the cellular drape 200 may be configured similarly to the cellular drape 100 described above with reference to FIGS. 1-10. For instance, the cellular drape 200 may be placed in operative association with a head rail assembly, blind tract assembly, a carrier assembly, or any other suitable support structure (e.g., as indicated by dashed lines 204 in FIG. 11) that is configured to vertically support the cellular drape 200 relative to an architectural structure (e.g., via a plurality of hangers 205). Additionally, the cellular drape 200 may be configured to be moved horizontally or laterally between an extended position (FIG. 11) and a retracted position (not shown). As shown in FIG. 11, when in the extended position, the cellular drape 200 may be configured to extend in a vertical or heightwise direction (indicated by arrow 206 in FIG. 11) between a top end 208 and a bottom end 210 and in a horizontal or lateral direction (indicated by arrow 212 in FIGS. 11-13) between a first lateral end 214 and a second lateral end 216. Additionally, when retracted, the cellular drape 200 may generally be configured to be collapsed into a folded or accordion-style configuration having a substantially flattened cellular profile. For example, the cellular drape 200 may be configured to take on the same or a similar folded or accordion-style configuration as that shown in FIGS. 2 and 6.

Figure 15:
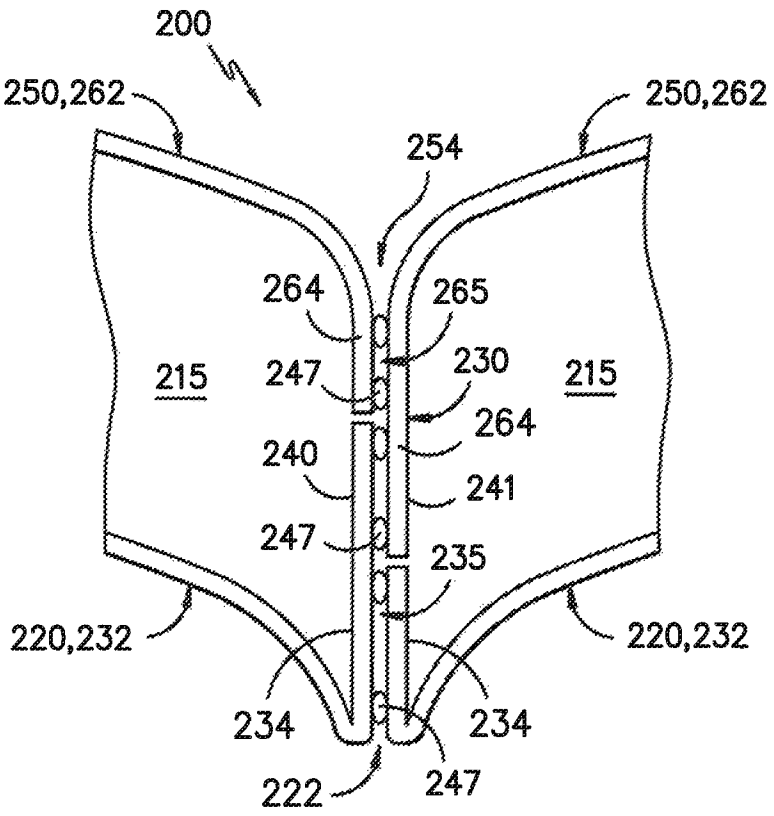
FIG. 15 illustrates another enlarged view of a portion of the cellular drape shown in FIG. 13.
Figure 14:
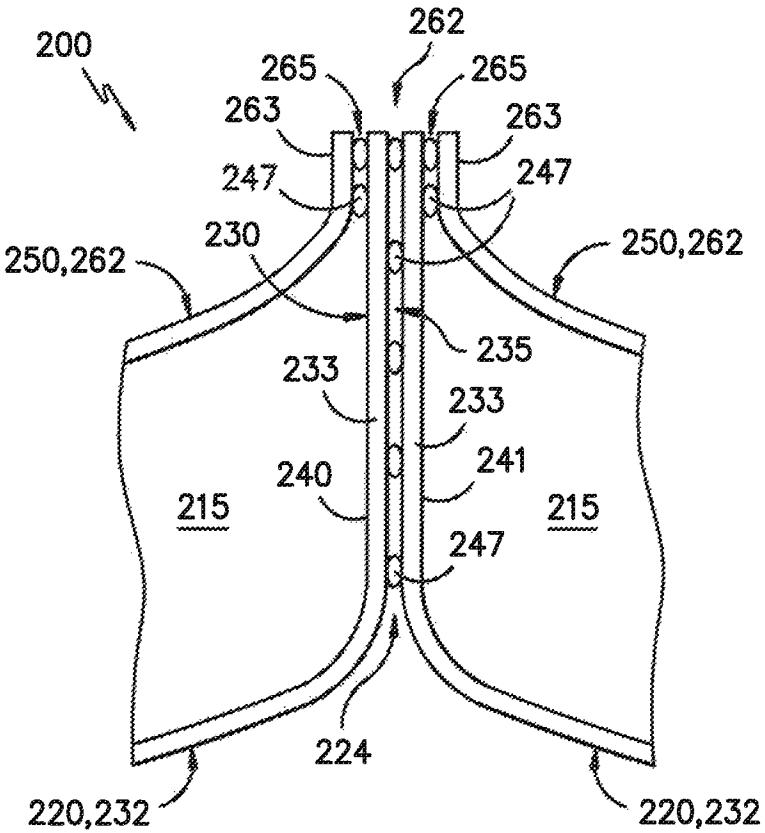
FIG. 14 illustrates an enlarged view of a portion of the cellular drape shown in FIG. 13.
Figure 16:
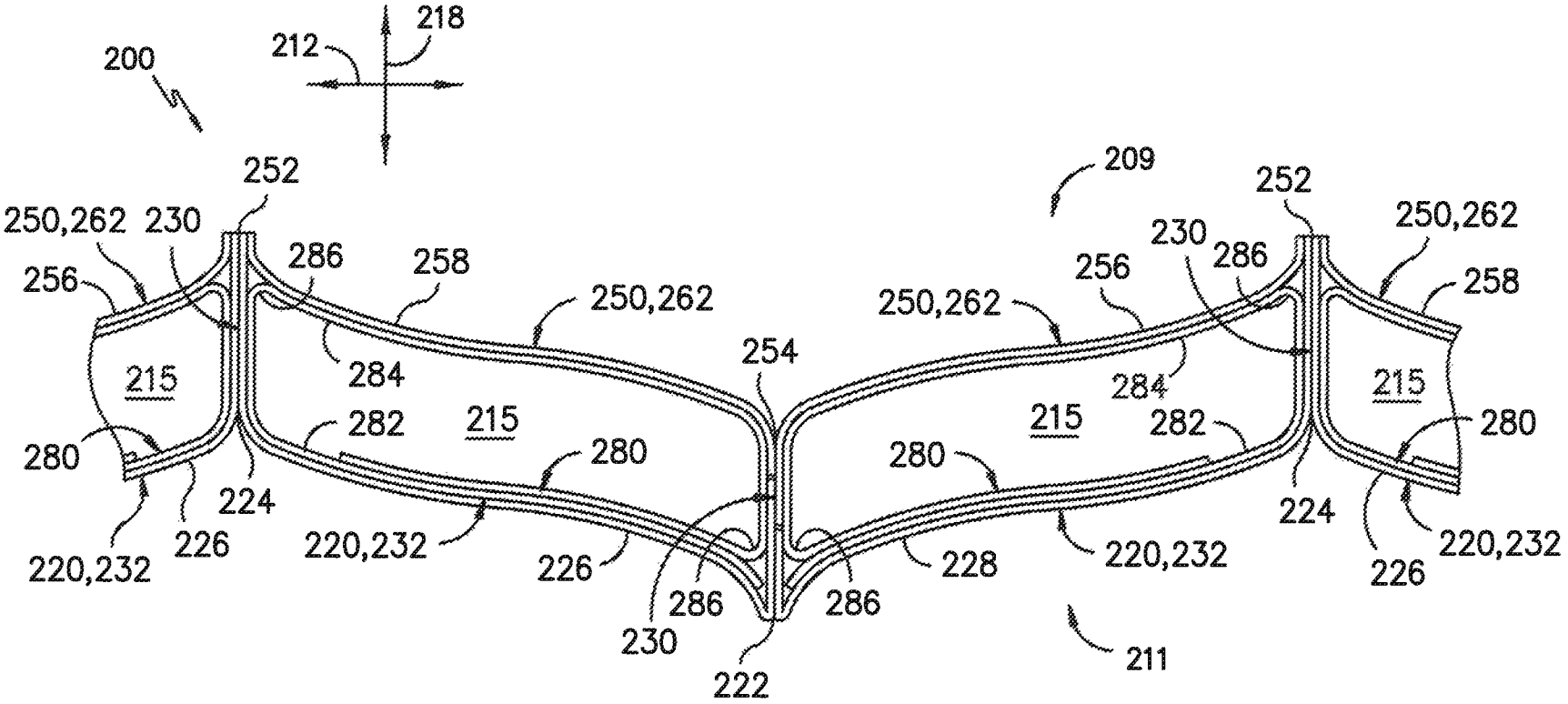
FIG. 16 illustrates another cross-sectional view of the cellular drape shown in FIG. 11 taken about line XVI-XVI.
Figure 17:
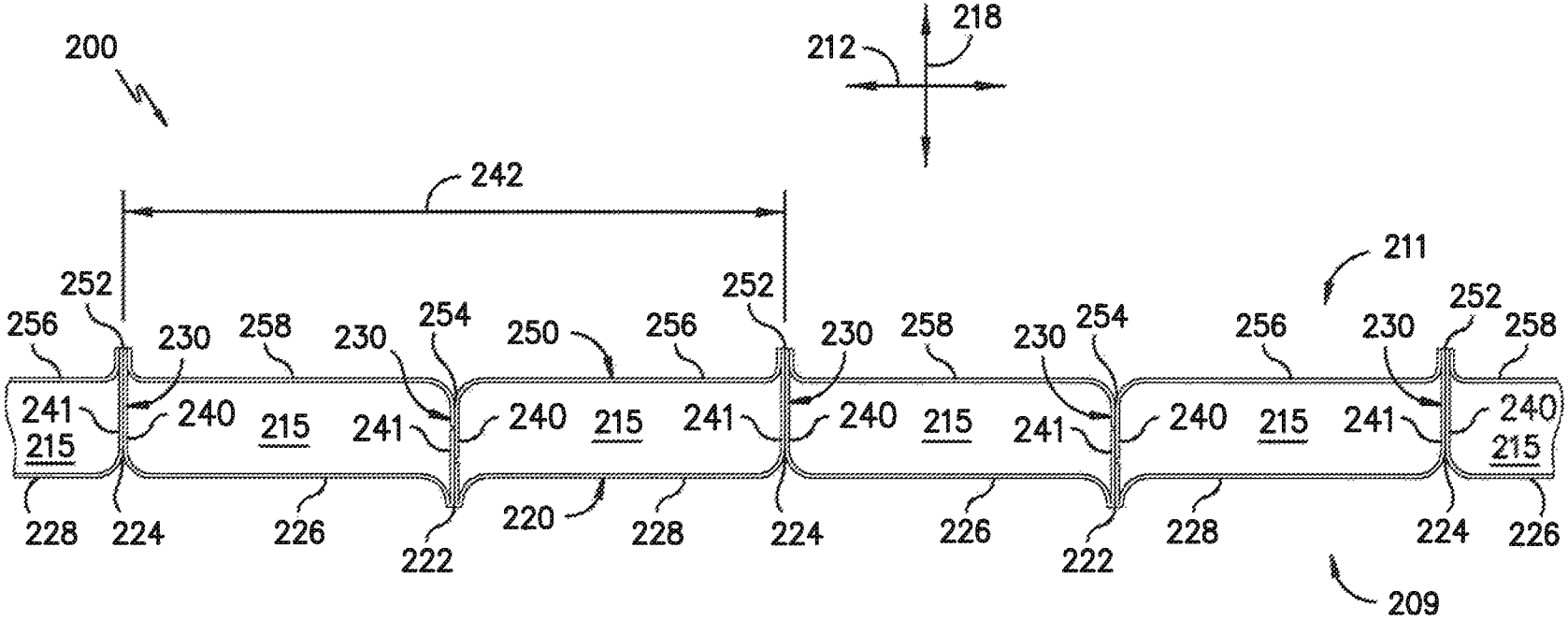
FIG. 17 illustrates a similar cross-sectional view of the cellular drape shown in FIG. 12, particularly illustrating the drape being laterally extended further than the configuration of the drape shown in FIG. 12.

It should be appreciated that, similar to the embodiments of the cellular drape 100 described above, the disclosed cellular drape 200 may be configured to take on or define various different cross-wise profiles between its opposed lateral ends 214, 216 based on the specific configuration of the cellular drape 200 and the degree to which the cellular drape 200 is "extended" or "unfolded" relative to the adjacent architectural structure 202. For example, FIGS. 12-16 illustrate cross-sectional views of the cellular drape 200 within which the drape 200 takes on or defines a substantially zig-zagged or staggered cross-wise profile along the lateral direction 212 when moved to the extended position. Alternatively, by increasing or decreasing the degree of extension of the cellular drape 200 relative to the configuration shown in FIGS. 12-16, the drape 200 may be configured to take on or define a different cross-wise profile. For instance, FIG. 17 illustrates the same cross-sectional view of the cellular drape 100 shown in FIG. 12 except that the drape 200 has been extended further outwardly in the lateral direction 212 away from its retracted position (e.g., by increasing the lateral tension within the cellular drape 200). As shown in FIG. 17, in such an embodiment, the cellular drape 200 takes on or defines a more planar cross-wise configuration between the opposed lateral ends 214, 216 of the drape 200.

In addition, the cellular drape 200 includes both a first or front drape panel 220 configured to define a front side or face 209 of the cellular drape 200 (e.g., between the opposed lateral ends 214, 216 and opposed top and bottom ends 208, 210 of the drape 200 along the exposed or outer face of the front drape panel 220) and a second or rear drape panel 250 configured to define a rear side or face 211 of the cellular drape 200 (e.g., between the opposed lateral ends 214, 216 and opposed top and bottom ends 208, 210 of the drape 200 along the exposed or outer face of the rear drape panel 250). Moreover, when the cellular drape 200 is moved to the extended position, portions of the front and rear drape panels 220, 250 may be configured to be spaced apart from each other in a cross-wise direction of the cellular drape 200 (e.g., as indicated by arrow 218 in FIGS. 11-13) so that a plurality of vertically oriented internal cells 215 are defined between the drape panels 220, 250. For instance, each internal cell 215 may be configured to extend in the vertical direction 206 between the top and bottom ends 208, 210 of the cellular drape 200 and in the cross-wise direction 218 of the drape 200 between the front and rear drape panels 206, 208.

Figure 12:
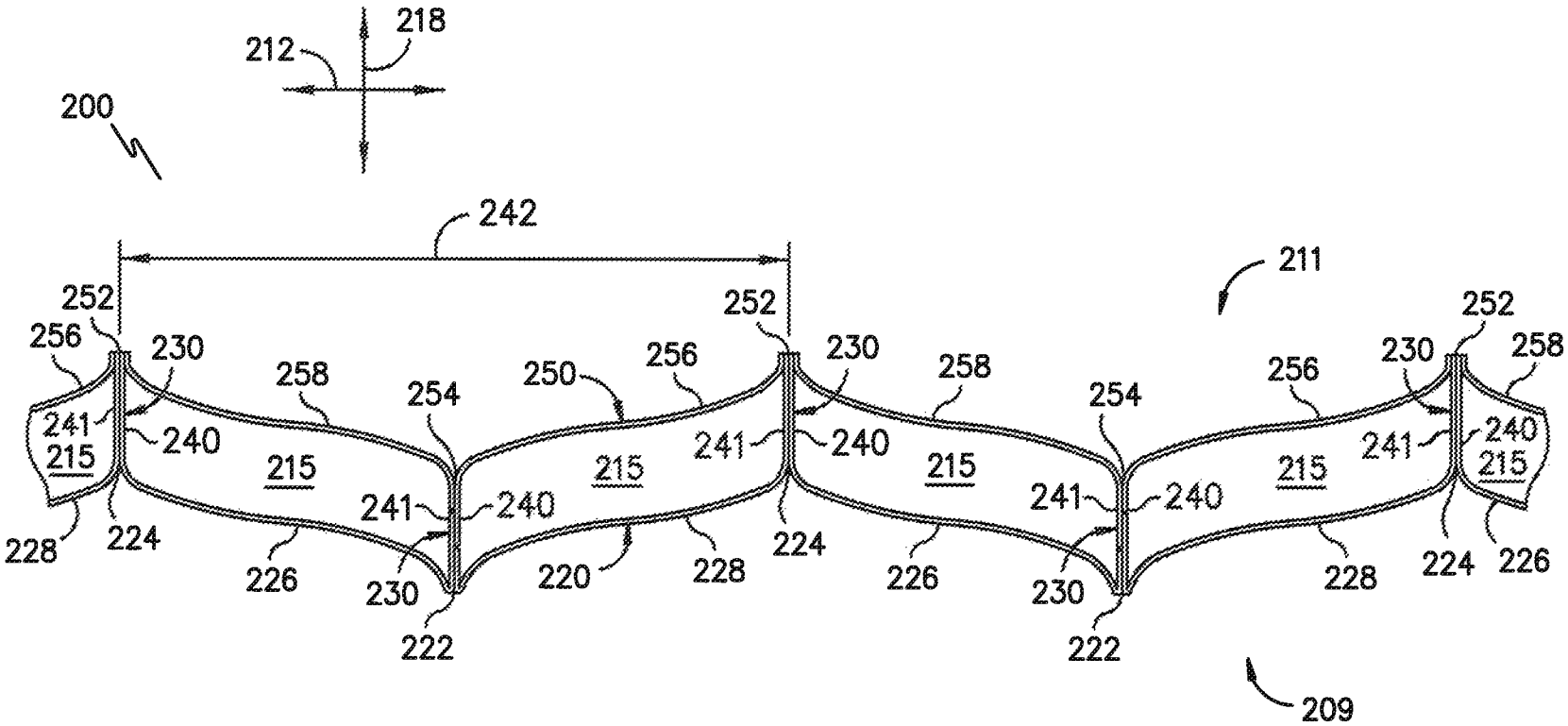
FIG. 12 illustrates a cross-sectional view of the cellular drape shown in FIG. 11 taken about line XII-XII.
Figure 13:
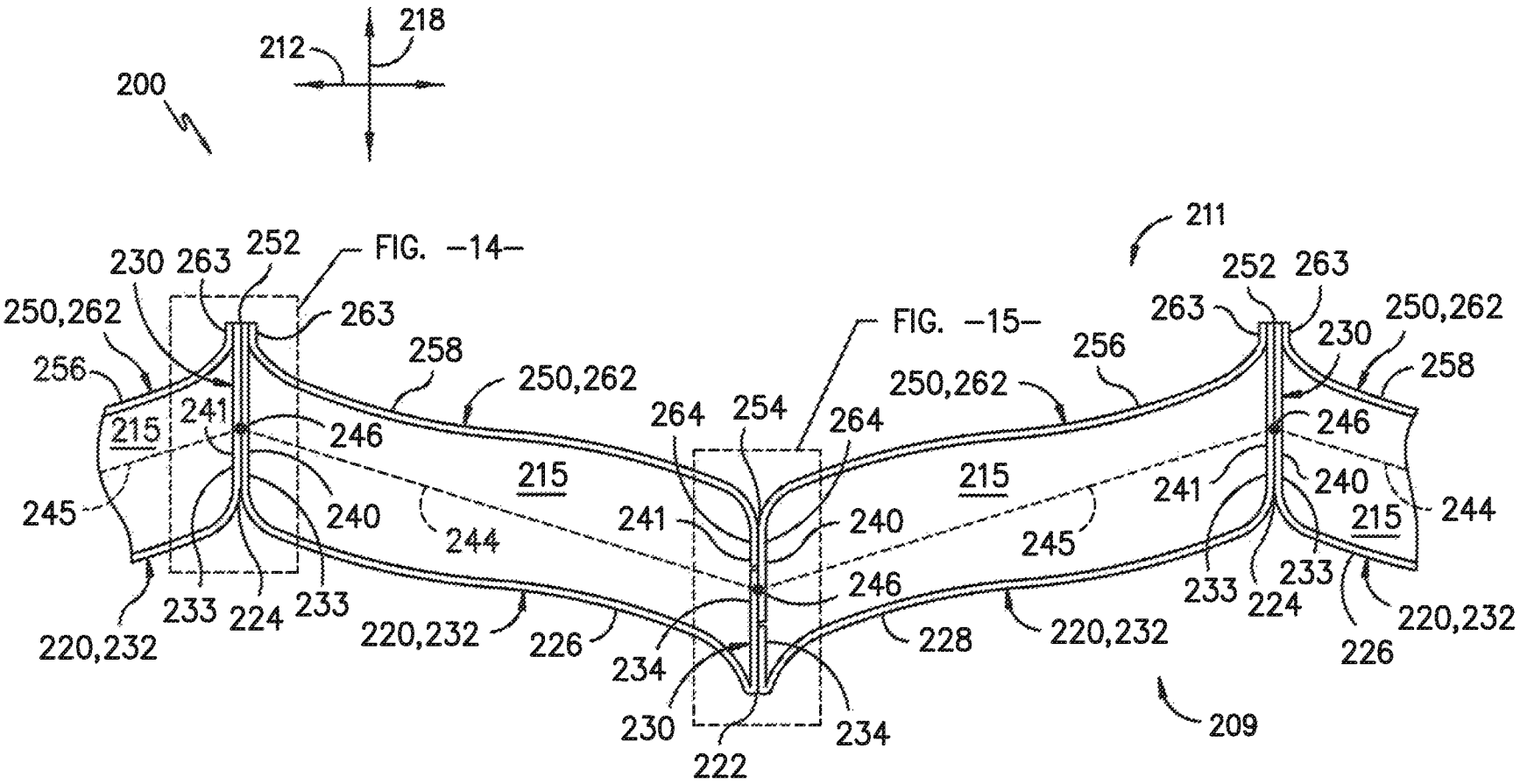
FIG. 13 illustrates an enlarged cross-sectional view of a portion of the cellular drape shown in FIG. 12.

Similar to the embodiments described above, the drape panels 220, 250 may have a pleated configuration so that each drape panel 220, 250 defines a plurality of vertically oriented pleats extending lengthwise between the top and bottom ends 208, 210 of the cellular drape 200. For example, as particularly shown in FIGS. 12, 13, and 16, the front drape panel 220 may include alternating front pleat peaks 222 and front pleat valleys 224 spaced apart across the front face 209 of the cellular drape 200 in the lateral direction 212, with first and second wall sections 226, 228 extending from each pleat peak 222 to the adjacent peaks valleys 224 of the front drape panel 220. Additionally, as shown in FIGS. 12, 13, and 16, the rear drape panel 250 may include alternating rear pleat peaks 252 and rear pleat valleys 254 spaced apart across the rear face 211 of the cellular drape 200 in the lateral direction 212, with first and second wall sections 256, 258 extending from each pleat peak 252 to the adjacent peaks valleys 254 of the rear drape panel 250.

It should be appreciated that, as described herein, the pleat peaks and valleys 222, 224, 252, 254 are defined relative to the outwardly-facing or exposed sides of the drape panels 220, 250. Specifically, the front pleat peaks 222 and front pleat valleys 224 are defined relative to the outwardly-facing or exposed side of the front drape panel 220 (i.e., the front face 209) such that the front pleat peaks 222 generally extend away from the rear drape panel 250 and the front pleat valleys 224 generally extend towards the rear drape panel 250 when viewing the front face 209 of the cellular drape 200. Similarly, the rear pleat peaks 252 and rear pleat valleys 254 are defined relative to the outwardly-facing or exposed side of the rear drape panel 250 (i.e., the rear face 211) such that the rear pleat peaks 252 generally extend away from the front drape panel 220 and the rear pleat valleys 254 generally extend towards the front drape panel 220 when viewing the rear face 211 of the cellular drape 200.

Moreover, in one embodiment, the pleat peaks and valleys 222, 224 defined by the front drape panel 220 may be interleaved relative to the pleat peaks and valley 252, 254 defined by the rear drape panel 250. Specifically, as shown in FIGS. 12, 13, and 16, the pleat peaks and valleys 222, 224, 252, 254 are provided in an alternating configuration across the front and rear faces 209, 211 of the cellular drape 200 such that each front pleat peak 222 is disposed in proximity with a corresponding rear pleat valley 254 (e.g., in the lateral or cross-wise direction 212, 218 of the drape 100) and each front pleat valley 224 is disposed in proximity with a corresponding rear pleat peak 252 (e.g., in the lateral or cross-wise direction 212, 218 of the drape 100). For example, in one embodiment, each front pleat peak 222 may be substantially aligned with a corresponding rear pleat valley 254 in the cross-wise direction 218 of the cellular drape 200 while each front pleat valley 224 may be substantially aligned with a corresponding rear pleat peak 252 in the cross-wise direction 218 of the cellular drape 200. Alternatively, the corresponding pleat peaks 222, 252 and valleys 224, 254 may be slightly offset from each other in the cross-wise direction 218.

Further, similar to the embodiments described above, the cellular drape 200 includes a plurality of internal tabs or ribs extending in the cross-wise direction 218 between the front and rear drape panels 220, 250. For example, as shown in FIGS. 12, 13, and 16, the internal ribs 230 may extend between the front and rear drape panels 220, 250 at the locations of the corresponding pleat peaks/valleys 222, 224, 252, 254 of the drape panels 220, 250, with each internal rib 230 extending vertically between the top and bottom ends 208, 210 of the drape 200. However, unlike the internal ribs 130, 160 described above with reference to FIGS. 3-7, the internal ribs 230 of the cellular drape 200 are formed from joints or junction lines defined between the front and rear drape panels 220, 250 so that the drape panels 220, 250 are coupled to each other along the vertical height of the drape 200 at the location of each internal rib 230. Specifically, as shown in FIGS. 12, 13, and 16, the internal ribs 230 may extend fully between the corresponding pleat peaks/valleys 222, 224, 252, 254 of the drape panels 220, 250 so as to allow the front drape panel 220 to be coupled to the rear drape panel 250 via each internal rib 230. As such, in addition to serving as stiffening or structural members between the drape panels 220, 250, the ribs 230 may also form dividing lines between adjacent internal cells 215 of the drape 204) so that each internal cell 215 has a closed configuration and is isolated from its adjacent internal cells 215 in the lateral direction 212 of the drape 200. For instance, as shown in FIGS. 12, 13, and 16, each internal rib 230 may form a common wall between adjacent closed cells 215 of the cellular drape 200. In such an embodiment, the lateral ends or sides of each internal cell 215 may be defined by adjacent internal ribs 230.

It should be appreciated that, in one embodiment, the front and rear drape panels 220, 250 may be formed from the same material. Alternatively, the front drape panel 220 may be formed from a material that differs from the material used to form the rear drape panel 250. For example, in one embodiment, the front drape panel 220 may be made from a material that does not permit significant amounts of light to pass through the material, while the rear drape panel 250 may be made from a material that allows much larger quantities of light to pass through the material. In this manner, the front face 209 of the cellular drape 200 may appear to illuminate when the drape 200 is in the extended position and light is striking the rear face 211 of the drape 200. Alternatively, the rear drape panel 250 may be made from a room-darkening or blackout material. Similarly, when the front drape panel 220 defines the side of the cellular drape 200 facing the interior of the room within which the drape 200 is installed (e.g., the front face or side 209), the front drape panel 220 may, for example, be formed from a material having an aesthetically pleasing design or texture. In such an embodiment, since the rear drape panel 250 may not be typically viewed, the rear drape panel 250 may be formed from a material that is less ornate and, thus, less expensive, thereby reducing the overall cost of manufacturing the cellular drape 200.

It should also be appreciated that each drape panel 220, 250 may be formed from separate strips or webs or material or, alternatively, each drape panel 220, 250 may be formed as a continuous sheet of material. For instance, FIG. 13 illustrates an enlarged view of a portion of the cellular drape 200 shown in FIG. 12 in which the front and rear drape panels 220, 250 are formed from separate vertical strips or webs of materials. Specifically, as shown in FIG. 13, the front drape panel 220 may be formed from separate, vertically extending front webs 232 coupled end-to-end across the width of the panel 220 so that each front web 232 forms one of the wall sections 226, 228 of the front drape panel 220 and extends between adjacent pleat peaks 222 and pleat valleys 224 of the front drape panel 220. In such an embodiment, each front web 232 may extend laterally between a first end portion 233 positioned adjacent to (and/or forming all or part of) the internal rib 230 defined between the adjacent pleat valley 224 of the front drape panel 220 and the corresponding pleat peak 252 of the rear drape panel 250 and a second end portion 234 positioned adjacent to (and/or forming all or part of) the internal rib 230 defined between the adjacent pleat peak 222 of the front drape panel 220 and the corresponding pleat valley 254 of the rear drape panel 250. For instance, as shown in the enlarged view of FIG. 14, the first end portions 233 of adjacent front webs 232 may be coupled to each other (e.g., by applying an adhesive 247 at an interface 235 defined between abutting, outer surfaces of the front webs 232 defined at the adjacent first end portions 233, with the first end portions 233 being subsequently pinched or pressed together at such interface 235) so as to form the adjacent pleat valley 224 of the front drape panel 220 as well as all or a part of the internal rib 230 defined between such pleat valley 224 and, also the corresponding pleat peak 252 of the rear drape panel 250. Additionally, as shown in the enlarged view of FIG. 15, the second end portions 234 of adjacent front webs 232 may be coupled to each other (e.g., e.g., by applying an adhesive 247 at an interface 235 defined between abutting, outer surfaces of the front webs 232 defined at the adjacent second end portions 234, with the second end portions 234 being subsequently pinched or pressed together at such interface 235) so as to form the adjacent pleat peak 222 of the front drape panel 220 as well as all or a part of the internal rib 230 defined between such pleat peak 222 and, also the corresponding pleat valley 254 of the rear drape panel 250.

Similarly, as shown in FIG. 13, the rear drape panel 250 may be formed from separate, vertically extending rear webs 262 coupled end-to-end across the width of the panel 250 so that each rear web 262 forms one of the wall sections 256, 258 of the rear drape panel 250 and extends between adjacent pleat peaks and pleat valleys 252, 254 of the rear drape panel 250. In such an embodiment, each rear web 262 may extend laterally between a first end portion 263 positioned adjacent to (and/or forming all or part of) the internal rib 230 defined between the adjacent pleat peak 252 of the rear drape panel 250 and the corresponding pleat valley 224 of the front drape panel 220 and a second end portion 264 positioned adjacent to (and/or forming all or part of) the internal rib 230 defined between the adjacent pleat valley 254 of the rear drape panel 250 and the corresponding pleat peak 222 of the front drape panel 220. For instance, as shown in the enlarged view of FIG. 14, the first end portions 263 of adjacent rear webs 262 may be coupled to adjacent first end portions 233 of the front webs 232 (e.g., by applying an adhesive 247 at an interface 265 defined between abutting surfaces of the front and rear webs 232, 262) so as to collectively define the adjacent pleat peak 252 of the rear drape panel 250. Similarly, as shown in the enlarged view of FIG. 15, the second end portions 264 of adjacent rear webs 262 may be coupled to each other (e.g., by applying an adhesive 247 at an interface 265 defined between abutting surfaces of the rear webs 262) so as to form the adjacent pleat valley 254 of the rear drape panel 250 as well as a portion of the internal rib 230 defined between such pleat valley 254 and the corresponding pleat peak 222 of the front drape panel 220. Moreover, as shown in FIG. 15, in addition to being coupled to each other, the second end portions 264 of the adjacent rear webs 262 may also be coupled to the adjacent second end portions 234 of the front webs 230 in an overlapped, offset configuration to provide a secure connection between the webs 232, 262 at the location of the corresponding internal rib 230.

It should be appreciated that, in the embodiment shown in FIGS. 12, 13, and 16, each internal cell 215 of the cellular drape 200 is generally defined by two separate webs of the cellular drape 200, namely each corresponding pair of front and rear webs 232, 262 of the drape panels 220, 250. Specifically, in one embodiment, each internal cell 215 may include a front side defined by one of the front webs 232 of the front drape panel 220 and a rear side defined by the aligned rear web 262 of the rear drape panel 250. Additionally, in such an embodiment, the lateral sides or ends of each internal cell 215 may be defined by the internal ribs 230 formed at least partially by each corresponding pair of front and rear webs 232, 262. For instance, as shown in FIG. 13, each internal cell 215 may extend in the lateral direction 112 of the cellular drape 100 between a first lateral side 240 (e.g., the lateral side of each cell 215 positioned closest to the first lateral end 214 of the cellular drape 200) and a second lateral side 241 (e.g., the lateral side of each cell 215 positioned closest to the second lateral end 216 of the cellular drape 200), with the each internal rib 230 generally extending along and/or defining the adjacent lateral sides 240, 241 of each adjacent pair of internal cells 215.

Moreover, in several embodiments, each internal cell 215 may be configured to define an angled orientation in the cross-wise direction 218 of the cellular drape 200 when the drape 200 is moved to the extended position. In such embodiments, the extent of the angled orientation defined by each internal cell 215 may vary, for example, based on the degree to which the cellular drape 200 is "extended" or "unfolded" when moved to the extended position from the retracted position (e.g., based on a peak-to-peak distance 242 (FIG. 12) defined between each pair of adjacent front pleat peaks 222). Specifically, in the illustrated embodiment, as the cellular drape 200 is moved from the retracted position towards the extended position, the cross-wise angular orientation of the internal cells 215 may decrease as the degree of extension of the cellular drape 200 increases. For example, when the drape 200 is moved to the extended position shown in FIGS. 12 and 13, each internal cell 215 may generally define a given angled orientation in the cross-wise direction 218 of the cellular drape 200 as each cell 215 extends laterally from its first lateral side 240 to its second lateral side 241. However, as the drape 200 is further extended from the configuration shown in FIGS. 12 and 13, the angled orientation of the internal cells 215 in the cross-wise direction 218 may be decreased. For example, as shown in FIG. 17, by increasing the lateral tension in the cellular drape 200, the internal cells 215 may define a more planar orientation relative to the cross-wise direction 218 of the cellular drape 200 as each internal cell 215 extends laterally from its first lateral side 240 to its second lateral side 241.

Additionally, similar to the embodiments described above, adjacent internal cells 215 of the vertical drape 200 may be configured to define alternating angled orientations between their first and second lateral sides 240, 241 in the cross-wise direction 218 of the drape 200. For example, when the drape 200 is moved to the extended position as shown in FIGS. 12 and 13, each internal cell 215 may define a cross-wise angular orientation from its first lateral side 240 to its second lateral side 241 that is generally directed towards one of the front face 209 or the rear face 211 of the cellular drape 200, with each immediately adjacent cell 215 defining a cross-wise angular orientation from its first lateral side 240 to its second lateral side 241 that is generally directed in the opposite cross-wise direction (e.g., towards the other of the front face 209 or the rear face 211 of the cellular drape 200). For instance, as particularly shown in FIG. 13, each internal cell 215 having its first lateral side 240 (i.e., the side closest to the first lateral end 214 of the cellular drape 200) formed at least partially by the first end portions 233 of the first webs 232 generally defines a first angled orientation (e.g., as indicated by first cell reference line 244 defined between reference points 246) extending from its first lateral side 240 to its second lateral side 241 that is directed or angled towards the front face 209 of the cellular drape 200 while each internal cell 215 having its first lateral side 240 formed at least partially by the second end portions 234 of the first webs 232 generally defines an opposed, second angled orientation (e.g., as indicated by second cell reference line 245 defined between reference points 246) extending from its first lateral side 240 to its second lateral side 241 that is directed or angled towards the rear face 211 of the cellular drape 200. This pattern of alternating angled orientations may be repeated in the lateral direction 212 of the cellular drape 200 (e.g., as shown in FIG. 12) such that each internal cell 215 having the first angled orientation 244 is positioned end-to-end with adjacent internal cells 215 having the second angled orientation 245.

It should be appreciated that, when the cellular drape 200 is moved to the extended position shown in FIGS. 12 and 13, the alternating angular orientations of the internal cells 215 may provide the drape w00 with a zigzagged, pleated and/or staggered cross-wise profile extending between the first and second lateral ends 214, 216 of the drape 200. In such an embodiment, the opposed angular orientations of each pair of adjacent internal cells 215 may allow the adjacent pairs of internal cells 215 to define a chevron or chevron-like shape. For instance, as shown in FIG. 13, the two internal cells 215 disposed along either side of the illustrated forward pleat peak 222 collectively form a forwardly-directed chevron shape, with the tip end or peak of the chevron shape being formed by the adjacent forward pleat peak 222. Similarly, each pair of internal cells 215 disposed along either side of each rear pleat peak 260 may be configured to collectively form a rearwardly-directed chevron shape, with the tip end or peak of the chevron shape being formed by the adjacent rear pleat peak 260.

It should also be appreciated that, in several embodiments, the cellular drape 200 may be configured to define a maximum peak-to-peak distance when in the extended position to allow the internal cells 215 to take on or otherwise define a desired angular orientation, thereby allowing the cellular drape 210 to be provided with a predetermined amount of fullness or cross-wise depth. In such embodiment, the maximum peak-to-peak distance may be defined using components or features of the support structure 204 associated with the cellular drape 200 or by configuring the cellular drape 200, itself, to only to be extended from the retracted position to an extended position at which the peak-to-peak distance 242 is equal to the desired maximum value.

Moreover, as shown in FIGS. 11 and 16, the cellular drape 200 also includes a plurality of headers 280 coupled between the drape panels 220, 250 at or adjacent to the top end 208 of the drape 200. In general, the headers 280 may be configured the same as or similar to the headers 180 described above with reference to FIGS. 1 and 5. Specifically, in one embodiment, each header 280 may have a looped configuration with opposed sides or walls of the header 280 being coupled to the adjacent wall sections 226, 228, 256, 258 (or adjacent webs 232, 262) of the drape panels 220, 250. For instance, as shown in FIG. 16, a front wall 282 of each header 280 may be coupled to the adjacent wall section 226, 228 (or adjacent front web 232) of the front drape panel 220 forming the front side of the corresponding internal cell 230 while a rear wall 284 of each header 280 may be coupled to the adjacent wall section 256, 268 (or adjacent rear web 262) of the rear drape panel 250 firming the rear side of such internal cell 215. Additionally, as shown in FIG. 16, in one embodiment, the front and rear walls 282, 284 of each header 280 may be configured to extend laterally between opposed fold or crease lines 286. In such an embodiment, when the vertical drape 200 is moved to the retracted position, the crease lines 286 may allow each header 280 to collapse into a flattened or closed configuration, thereby allowing the cellular drape 200 to assume the folded or accordion-style configuration described above. Moreover, although not shown, it should be appreciated that each header 200 may, in one embodiment, also include one or more slots or openings configured to receive portions of the hangers 205 or other attachment structure configured to facilitate suspending the cellular drape 200 from its corresponding support structure 204 (e.g., similar to the slots/openings 190 shown in FIG. 9).

While the foregoing Detailed Description and drawings represent various embodiments, it will be understood that various additions, modifications, and substitutions may be made therein without departing from the spirit and scope of the present subject matter. Each example is provided by way of explanation without intent to limit the broad concepts of the present subject matter. In particular, it will be clear to those skilled in the art that principles of the present disclosure may be embodied in other forms, structures, arrangements, proportions, and with other elements, materials, and components, without departing from the spirit or essential characteristics thereof. For instance, features illustrated or described as part of one embodiment can be used with another embodiment to yield a still further embodiment. Thus, it is intended that the present subject matter covers such modifications and variations as come within the scope of the appended claims and their equivalents. One skilled in the art will appreciate that the disclosure may be used with many modifications of structure, arrangement, proportions, materials, and components and otherwise, used in the practice of the disclosure, which are particularly adapted to specific environments and operative requirements without departing from the principles of the present subject matter. For example, elements shown as integrally formed may be constructed of multiple parts or elements shown as multiple parts may be integrally formed, the operation of elements may be reversed or otherwise varied, the size or dimensions of the elements may be varied. The presently disclosed embodiments are therefore to be considered in all respects as illustrative and not restrictive, the scope of the present subject matter being indicated by the appended claims, and not limited to the foregoing description.

In the foregoing Detailed Description, it will be appreciated that the phrases "at least one", "one or more", and "and/or", as used herein, are open-ended expressions that are both conjunctive and disjunctive in operation. The term "a" or "an" element, as used herein, refers to one or more of that element. As such, the terms "a" (or "an"), "one or more" and "at least one" can be used interchangeably herein. All directional references (e.g., proximal, distal, upper, lower, upward, downward, left, right, lateral, longitudinal, front, rear, top, bottom, above, below, vertical, horizontal, crosswise, radial, axial, clockwise, counterclockwise, and/or the like) are only used for identification purposes to aid the reader's understanding of the present subject matter, and/or serve to distinguish regions of the associated elements from one another, and do not limit the associated element, particularly as to the position, orientation, or use of the present subject matter. Connection references (e.g., attached, coupled, connected, joined, secured, mounted and/or the like) are to be construed broadly and may include intermediate members between a collection of elements and relative movement between elements unless otherwise indicated. As such, connection references do not necessarily infer that two elements are directly connected and in fixed relation to each other. Identification references (e.g., primary, secondary, first, second, third, fourth, etc.) are not intended to connote importance or priority, but are used to distinguish one feature from another.

All apparatuses and methods disclosed herein are examples of apparatuses and/or methods implemented in accordance with one or more principles of the present subject matter. These examples are not the only way to implement these principles but are merely examples. Thus, references to elements or structures or features in the drawings must be appreciated as references to examples of embodiments of the present subject matter, and should not be understood as limiting the disclosure to the specific elements, structures, or features illustrated. Other examples of manners of implementing the disclosed principles will occur to a person of ordinary skill in the art upon reading this disclosure.

This written description uses examples to disclose the present subject matter, including the best mode, and also to enable any person skilled in the art to practice the present subject matter, including making and using any devices or systems and performing any incorporated methods. The patentable scope of the present subject matter is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

The following claims are hereby incorporated into this Detailed Description by this reference, with each claim standing on its own as a separate embodiment of the present disclosure. In the claims, the term "comprises/comprising" does not exclude the presence of other elements or steps. Furthermore, although individually listed, a plurality of means, elements or method steps may be implemented by, e.g., a single unit or processor. Additionally, although individual features may be included in different claims, these may possibly advantageously be combined, and the inclusion in different claims does not imply that a combination of features is not feasible and/or advantageous. In addition, singular references do not exclude a plurality. The terms "a", "an", "first", "second", etc., do not preclude a plurality. Reference signs in the claims are provided merely as a clarifying example and shall not be construed as limiting the scope of the claims in any way.

What is claimed is:

1. A vertical cellular drape for an architectural structure, said cellular drape extending in a vertical direction between a top end and a bottom end and in a lateral direction between a first lateral end and a second lateral end, said cellular drape being movable in the lateral direction between an extended position and a retracted position, said cellular drape comprising:

a front drape panel defining a front face of said cellular drape;

a rear drape panel coupled to said front drape panel, said rear drape panel defining a rear face of said cellular drape opposite said front face; and a plurality of headers positioned at or adjacent to said top end of said cellular drape, said headers being coupled between said front and rear drape panels;

wherein:

said front and rear drape panels are configured to extend vertically downwardly from said headers relative to each other when said cellular drape is in said extended position such that a plurality of internal cells are defined between said front and rear drape panels that extend lengthwise in the vertical direction from said headers to said bottom end of said cellular drape; and said headers are configured to expand and collapse as said cellular drape is moved between the extended and retracted positions, respectively.

2. The vertical cellular drape of claim 1, wherein each header is configured to push said front and rear drape panels away from each other as each header expands when said cellular drape is moved to the extended position such that said internal cells are defined between said front and rear drape panels.

3. The vertical cellular drape of claim 1, wherein each header comprises a front wall coupled to a portion of said front drape panel at or adjacent to said top end of said cellular drape and a rear wall coupled to a portion of said rear drape panel at or adjacent to said top end of said cellular drape.

4. The vertical cellular drape of claim 3, wherein said front and rear walls are configured to expand outwardly away from each other when said cellular drape is moved to the extended position.

5. The vertical cellular drape of claim 1, wherein each header is positioned within a corresponding internal cell of said internal cells defined between said front and rear drape panels.

6. The vertical cellular drape of claim 1, wherein each header is configured to extend across adjacent internal cells defined between said front and rear drape panels.

7. The vertical cellular drape of claim 1, wherein said rear drape panel is coupled to said front drape panel at said top end of said cellular drape only via said headers such that said front and rear drape panels are suspended relative to each other from said headers.

8. The vertical cellular drape of claim 1, wherein each header defines at least one attachment feature configured to allow said header to be coupled to a corresponding support structure of said cellular drape.

9. The vertical cellular drape of claim 1, wherein:

said front drape panel defines a plurality of front pleats across said front face of said vertical cellular drape;

said rear drape panel defines a plurality of rear pleats across said rear face of said vertical cellular drape; and each of said rear pleats is disposed in proximity to a corresponding front pleat of said front drape panel in the lateral direction of said cellular drape to form a plurality of corresponding pairs of front and rear pleats.

10. The vertical cellular drape of claim 9, further comprising a plurality of internal ribs positioned between said front and rear faces of said cellular drape and extending in the vertical direction between said top and bottom ends of said cellular drape; each of said ribs extending between said front and rear drape panels at or adjacent to a corresponding pair of said front and rear pleats.

11. The cellular drape of claim 1, wherein:

said cellular drape extends in a cross-wise direction between said front face and said rear face;

each of said plurality of internal cells extends in the lateral direction of said cellular drape between a first lateral side and a second lateral side;

when said cellular drape is moved to the extended position, adjacent internal cells of said plurality of internal cells define alternating angled orientations between their first and second lateral sides in the cross-wise direction of said cellular drape.

12. A vertical cellular drape assembly for an architectural structure, said cellular drape assembly comprising:

a cellular drape extending in a vertical direction between a top end and a bottom end and in a lateral direction between a first lateral end and a second lateral end, said cellular drape extending in a cross-wise direction between a front face and a rear face; said cellular drape being movable in the lateral direction between an extended position and a retracted position, said cellular drape comprising:

a front drape panel defining said front face of said cellular drape, said front drape panel defining alternating front pleat peaks and front pleat valleys across said front face of said cellular drape;

a rear drape panel defining said rear face of said cellular drape, said rear drape panel defining alternating rear pleat peaks and rear pleat valleys across said rear face of said cellular drape; and a plurality of internal cells defined between said front and rear drape panels and extending vertically between said top and bottom ends of said cellular drape, each of said plurality of internal cells extending in the lateral direction between a first lateral cell side and a second lateral cell side and extending in the cross-wise direction from an inner surface of the front drape panel to an inner surface of the rear drape panel;

wherein:

said first lateral cell side of each of said plurality of internal cells is defined at least partially by a first internal wall of said cellular drape formed by at least one of a front pleat valley of said front drape panel or a rear pleat peak of said rear drape panel substantially aligned with said front pleat valley in the cross-wise direction;

said second lateral cell side of each of said plurality of internal cells is defined at least partially by a second internal wall of said cellular drape formed by at least one of a front pleat peak of said front drape panel or a rear pleat valley of said rear drape panel substantially aligned with said front pleat peak in the cross-wise direction; and when said cellular drape is moved to said extended position, adjacent internal cells of said plurality of internal cells define alternating angled orientations between their first and second lateral cell sides in the cross-wise direction of said cellular drape.

13. The vertical cellular drape assembly of claim 12, wherein:

said first lateral cell side of each of said plurality of internal cells is closer to said first lateral end of said cellular drape;

said second lateral cell side of each of said plurality of internal cells is closer to said second lateral end of said cellular drape;

said plurality of internal cells comprise a first internal cell, a second internal cell spaced apart from said first internal cell in the lateral direction of said cellular drape, and a third internal cell extending directly between said first and second internal cells in the lateral direction such that said first, second, and third internal cells are defined end-to-end; and in said extended position, each internal cell of said first and second internal cells defines a first angled orientation from its first lateral cell side to its second lateral cell side that extends in the cross-wise direction towards said front face of cellular drape, and said third internal cell defines an opposed second angled orientation from its first lateral cell side to its second lateral cell side that extends in the cross-wise direction towards said rear face of cellular drape.

14. The vertical cellular drape assembly of claim 12, wherein:

said plurality of internal cells comprises a plurality of first internal cells spaced apart from one another in the lateral direction of said cellular drape and a plurality of second internal cells extending directly between neighboring pairs of said first internal cells in the lateral direction such that said plurality of internal cells alternate between said first and second internal cells between said first and second lateral ends of said cellular drape;

in said extended position, each of said first internal cells defines a first angled orientation in the cross-wise direction between its first and second lateral cell sides and each of said second internal cells defines an opposed second angled orientation in the cross-wise direction between its first and second lateral cell sides.

15. The vertical cellular drape assembly of claim 14, wherein:

a cell reference line is defined for each internal cell that extends between a first reference point defined along said first lateral cell side of each internal cell at a given cross-wise distance from one of said front drape panel or said rear drape panel and a corresponding second reference point defined along said second lateral cell side of each internal cell at the same cross-wise distance from said one of said front drape panel or said rear drape panel;

when at said first angled orientation, said cell reference line defines a positive cross-wise angle relative to the lateral direction of said cellular drape; and when at said second angled orientation, said cell orientation reference line defines a negative cross-wise angle relative to the lateral direction of said cellular drape.

16. The vertical cellular drape assembly of claim 12, wherein:

said vertical cellular drape further comprises a plurality of headers positioned at or adjacent to said top end of said cellular drape and coupled to said one or more support elements;

said headers are coupled between said front and rear drape panels; and said front and rear drape panels are configured to extend vertically downwardly from said headers relative to each other to said free bottom end of said cellular drape.

17. The vertical cellular drape assembly of claim 12, wherein:

said drape assembly further comprises a support structure including one or more support elements coupled to said cellular drape adjacent said top end of said cellular drape to facilitate moving said cellular drape in the lateral direction between the extended and retracted positions; and said cellular drape is suspended from said support structure in the vertical direction such that said bottom end of said cellular drape comprises a free bottom end of said cellular drape.

18. The vertical cellular drape assembly of claim 17, wherein structural support for said cellular drape for movement between the extended and retracted positions is limited to said one or more support elements of said support structure.

19. The vertical cellular drape assembly of claim 17, wherein an interior volume of each of said plurality of internal cells extending in the vertical direction between said one or more support elements and said bottom end of said cellular drape is free from support elements configured to support said cellular drape for movement between the extended and retracted positions.

20. The vertical cellular drape assembly of claim 17, wherein portions of said first and second lateral ends of said cellular drape positioned below said one or more support elements of said support structure in the vertical direction comprise unsupported lateral end portions of said cellular drape.

21. The vertical cellular drape assembly of claim 17, wherein:

said one or more support elements are coupled to said cellular drape at one or more corresponding attachment locations positioned adjacent said top end of said cellular drape; and a remainder of said cellular drape positioned below said one or more corresponding attachment locations in the vertical direction hangs freely relative to said support structure.

22. The vertical cellular drape assembly of claim 12, wherein said front pleat peaks and said front pleat valleys of said front drape panel are interleaved relative to said rear pleat peaks and said rear pleat valleys of said rear drape panel such that each of said rear pleat peaks is substantially aligned in the cross-wise direction with a corresponding front pleat valley of said front drape panel and each of said rear pleat valleys is substantially aligned in the cross-wise direction with a corresponding front pleat peak of said front drape panel.

23. The vertical cellular drape assembly of claim 12, wherein adjacent pairs of said plurality of internal cells collectively define a chevron shape.

24. The vertical cellular drape assembly of claim 12, wherein:

said first internal wall of each of said plurality of internal cells extends at least partially in the cross-wise direction of said cellular drape across a gap defined between said front pleat valley of said front drape panel and said rear pleat peak of said rear drape panel; and said second lateral cell side of each of said plurality of internal cells extends at least partially in the cross-wise direction of said cellular drape across a gap defined between said front pleat peak of said front drape panel and said rear pleat valley of said rear drape panel.

25. A vertical cellular drape for an architectural structure, said cellular drape extending in a vertical direction between a top end and a bottom end and in a lateral direction between a first lateral end and a second lateral end, said cellular drape being movable in the lateral direction between an extended position and a retracted position, said cellular drape comprising:

a front drape panel defining a front face of said cellular drape, said front drape panel defining alternating front pleat peaks and front pleat valleys across said front face of said cellular drape;

a rear drape panel coupled to said front drape panel, said rear drape panel defining a rear face of said cellular drape opposite said front face, said rear drape panel defining alternating rear pleat peaks and rear pleat valleys across said rear face of said cellular drape, each of said rear pleat peaks being substantially aligned in the cross-wise direction of said cellular drape with a corresponding front pleat valley of said front drape panel and each of said rear pleat valleys being substantially aligned in the cross-wise direction of said cellular drape with a corresponding front pleat peak of said front drape panel to form a plurality of corresponding pairs of drape peaks and valleys in the cross-wise direction of said cellular drape; and a plurality of internal ribs positioned between said front and rear faces of said cellular drape and extending in the vertical direction between said top and bottom ends of said cellular drape, each rib of said plurality of internal ribs extending between said front and rear drape panels in the cross-wise direction at a respective pair of drape peaks and valleys of said plurality of corresponding pairs of drape peaks and valleys without providing a direct connection between said respective pair of drape peaks and valleys;

wherein said first and second drape panels are configured to be positioned relative to each other when said cellular drape is in the extended position such that a plurality of internal cells are defined between said front and rear drape panels that extend in the vertical direction between said top and bottom ends of said cellular drape.

26. The vertical cellular drape of claim 25, wherein each rib of said plurality of internal ribs extends between said front and rear drape panels in the cross-wise direction without providing a direct connection between said respective pair of drape peaks and valleys.

* * * * *